US007137873B2

(12) United States Patent
Mase et al.

(10) Patent No.: US 7,137,873 B2
(45) Date of Patent: Nov. 21, 2006

(54) GRINDING METHOD FOR WORKPIECE, JET GUIDE MEANS AND JET REGULATION MEANS USED FOR THE METHOD

(75) Inventors: Keiji Mase, Tokyo (JP); Shozo Ishibashi, Tokyo (JP)

(73) Assignee: Fuji Manufacturing Co., Ltd., Tokyo (JP)

( * ) Notice: Subject to any disclaimer, the term of this patent is extended or adjusted under 35 U.S.C. 154(b) by 15 days.

(21) Appl. No.: 10/873,718

(22) Filed: Jun. 22, 2004

(65) Prior Publication Data

US 2004/0266317 A1 Dec. 30, 2004

(30) Foreign Application Priority Data

Jun. 30, 2003 (JP) ..... 2003-188763

(51) Int. Cl.
*B24B 1/00* (2006.01)

(52) U.S. Cl. ..... 451/38; 451/75; 451/90; 451/102; 451/415; 451/438; 451/439; 451/446; 451/457

(58) Field of Classification Search ..... 451/38, 451/39, 40, 75, 76, 89, 90, 102, 415, 438, 451/439, 446, 454, 457
See application file for complete search history.

(56) References Cited

U.S. PATENT DOCUMENTS 4,369,605 A * 1/1983 Opersteny et al. ..... 451/38
4,633,623 A * 1/1987 Spitz ..... 451/102
5,261,191 A * 11/1993 Wick ..... 451/39
5,551,909 A * 9/1996 Bailey ..... 451/75
5,833,517 A * 11/1998 Konda et al. ..... 451/29
5,910,338 A * 6/1999 Donde ..... 427/290
6,273,788 B1 * 8/2001 Shaw ..... 451/38
6,402,593 B1 * 6/2002 Shaw ..... 451/36
6,422,920 B1 * 7/2002 Bouten et al. ..... 451/29
6,464,570 B1 * 10/2002 Shaw et al. ..... 451/102
6,482,076 B1 * 11/2002 Straub et al. ..... 451/38
6,520,838 B1 * 2/2003 Shaw ..... 451/38
6,561,874 B1 * 5/2003 Kordonski ..... 451/38
6,655,026 B1 * 12/2003 Iida et al. ..... 29/888.09
6,827,634 B1 * 12/2004 Akedo ..... 451/54

* cited by examiner

*Primary Examiner*—Eileen P. Morgan
(74) *Attorney, Agent, or Firm*—Donn K. Harms

(57) ABSTRACT

A grinding method is provided which can grind a processing surface of a workpiece by a blast processing without use of specific abrasives to obtain a glossy surface such as a mirror surface. Abrasives together with compresses fluid are injected to the processing surface of the workpiece with an incident angle θ to meet the condition shown in the following equation:

$$0 < V \cdot \sin\theta \leq \tfrac{1}{2} \cdot V \qquad \text{Equation 1;}$$

V=speed of the abrasive in an injection direction

θ=incident angle of the abrasive to the processing surface of the workpiece.

21 Claims, 27 Drawing Sheets

Relationship between an injection angle and a surface roughness

Preliminary treatment 90°

Injection angle 60°

Injection angle 30°

Injection angle 20°

Injection angle 5°

Graph showing a roughness curve after dising in a silicon wafer processing

Roughness curve of a preliminary treatment
(Injection angle 90°)

Roughness curve after processing by the embodiment

A processed surface and a preliminary treatment surface of the embodiment (Preliminary treatment surface) (Processed surface)

GRINDING METHOD FOR WORKPIECE, JET GUIDE MEANS AND JET REGULATION MEANS USED FOR THE METHOD

FIELD OF THE INVENTION

The present invention relates to a grinding method for a workpiece, and a jet guide means and a jet regulation means for use in the grinding method and more particularly to a grinding method for a processing surface of workpiece to be a glossy surface and the like using a blast processing device such as sand blasting or wet blasting which injects abrasive materials together with compressed fluid, and to a jet guide means which generates a jet of abrasive materials enabling such grinding, and a jet regulation means in the jet guide means.

DESCRIPTION OF THE PRIOR ART

As a known grinding method which improves surface roughness of a surface of a workpiece for smooth surface such as a mirror finished surface, there are, for instance, grinding by an abrasive paper or an abrasive cloth, buffing, lapping, grinding by contacting rotating abrasive grains, superfinishing process which grinds the workpiece by contacting abrasive grains provided with ultrasonic vibration, and the like.

On the other hand, blast processing that performs cutting and the like by injecting abrasives on the surface of a workpiece, although it is a process technology using the abrasives likewise, has not been generally used for the grind process of the workpiece surface to obtain a glossy surface but is used for satin finish as a typical example which will be described later.

This is because in the blast processing the processing is performed by crashing the injected abrasives on the surface of the workpiece, and as a result, unevenness are formed on the surface of the workpiece which has collided with these abrasives, making the surface of the workpiece be a satin finished surface. Thus, the surface unevenness formed on the surface of the workpiece does not produce a glossy surface such as a mirror surface, due to the diffused reflection of light incident on the processed surface.

The degree of the unevenness generated on the surface of the workpiece by this blast processing varies depending on blasting conditions such as material property and hardness of the workpiece, material property and hardness of the abrasives, grain size, grain shape, injection pressure and injection amount. Accordingly, by changing these processing conditions, the shape of each impression forming the unevenness on the surface can be controlled. However, even if the grain sizes are made smaller, thereby to reduce the respective diameters of impressions formed, it is unavoidable that the unevenness are formed on the surface of the workpiece anyway, resulting in the occurrence of diffused reflection of light. Therefore, the processed surface of the workpiece cannot become a glossy surface like the mirror surface.

One example of blast processing shows that a silicon wafer was used as a workpiece and Fuji random WA (White Alundum of Fuji Manufacturing Co., Ltd.; trademark) having a grain size of # 3000 (5 μm, average of average diameter; 5.9~4.7 μm) were blasted on the surface of the silicon wafer by a SGF-4 (sand blasting device of Fuji Manufacturing Co., Ltd.) and the surface of the workpiece could not achieve a glossy surface.

Thus, generally known blast processing methods cannot usually grind the surface of the workpiece to achieve a glossy surface, but even with surface treatment by such blast processing method, the following grinding method has been proposed that the formation of a satin finished surface on the processing surface of the workpiece is suppressed to perform glazing to the processing surface of the workpiece.

According to this grinding method, grinding powder is adhered to carriers made of a flexible, porous plant fiber by adhesives of fat or sugar contained in tho plant fiber to form abrasive grains. These abrasive grains are mixed with grinding fluid, which are injected on the surface of the workpiece from the oblique direction so that the abrasive grains are slid on the surface of the workpiece while the carriers being deformed plastically. The surface of the workpiece is thus finished by the above grinding powder (Japan Issued Patent No. 2957492, P1–4, FIG. 1, FIG. 2).

In the known methods such as grinding by an abrasive cloth or an abrasive paper, lapping, grinding by a grinding stone or the like among the above mentioned conventional grinding/cutting methods, the abrasive of a small grain size has weak grinding force, which requires plural stages of grinding processes where grain size of abrasives is gradually reduced, resulting in the complexity of the grinding.

Grinding quantity depends on the processing pressure and therefore, if the processing pressure is set to be low for avoiding excessive processing distortions, the processing speed is lowered, causing poor productivity.

In contrast, in case high processing pressure is applied, cutting cracks of grinding cracks may occur.

On the surface layer of a workpiece, which is ground while the processing pressure is still applied to the workpiece, the processing distortions occur as described above. Accordingly in the case of a workpiece is a silicon wafer, for instance, removal of the processing distortions generated in the grind processing may be required for securing perfect crystal layer in the vicinity of the wafer surface. Therefore, such processes are required as heat treatment for the wafer ground after the grinding process, or removing process of the surface layer by using acid or alkali. In the case of removing the surface layer by using acid or alkali, proper treatment of the waste fluid such as the acid or alkali used for the processes is required, thereby causing an extremely complicated work.

On the other hand, according to the Grinding Method for Work Surface disclosed in the above Japan Patent No. 2957492, it is possible to perform glazing by a blasting method without producing satin finishing on the workpiece surface. However, according to the method in this document, such injection method is adopted that the abrasive grains are injected by a centrifugal force generated by rotating a bladed wheel, and in order to slide abrasive grains on the workpiece, the abrasive grains, the carrier of which is relatively soft and porous hence deformed plastically on collision with the workpiece surface, are controlled to slide along the workpiece surface by lubricating function of grinding fluid (the above-described Japan Issued Patent No. 2957492, paragraph 0006). For the purpose of obtaining travel of the abrasive grains along the workpiece surface, it is essential to use abrasive grains with a special structure having elastic performance to absorb the collision impulse of the abrasive grains against the workpiece surface, and to prevent the reaction therefrom.

Moreover, since the above described carriers of abrasive grains are produced from plant fiber, in case the abrasive grains are injected with usual injection pressure used in an air type blasting processing, for example, destruction or the like occurs and therefore, it is required to inject with lower injection speeds. As a result, even in the case of grinding a workpiece with the method described in the above Japan Issued Patent No. 2957492, it is not expected to have a big improvement of productivity in the grinding.

In the present invention, since a jet emitted along a wall surface has a property to flow along the wall surface even if the wall surface is curved (Coanda effect or the like), travel of abrasives along the surface of the workpiece is possible even in the case of using generally known abrasives without using special structural abrasives disclosed in the related art. Incidentally, it is confirmed that as a grain size of the abrasive becomes #2000 or more (7.9 μm, maximum grain size: 26 μm or less, average of average grain size: 8.9–7.1 μm), the abrasives move together with the flow of the jet.

The present invention is completed based upon the above understanding and the experiment result that abrasives travel along the processing surface of a workpiece can be procured by setting an incident angle of the abrasives to the processing surface of the workpiece within a predetermined range. The present invention has an object of providing a method of grinding a workpiece by which roughness of a processed surface of the workpiece is improved by using conventional abrasives or a blast processing device and the processed surface thereof is ground to a desired glossy surface such as a mirror surface or the like without use of the above described special abrasives or cutting fluid.

And since the grinding is not performed under the application of pressure, occurrence of processing distortions on the surface of the workpiece is prevented, accordingly the present invention provides a processing method of omitting heat treatment of removing the processing distortions after processing and removal of a surface layer by acid or alkali fluid, as well as reducing the treatment process thereof even in the case of grinding a workpiece such as a silicon wafer and the like to which occurrence of processing distortions is objectionable.

The present invention has another object of providing a jet guide means which enables injection of abrasives to a processed surface of a workpiece under the conditions required for enabling the easy implementation of said grinding method by using, for example, conventional blast processing devices, and a jet regulation means which prevents the jet of abrasives along the processing surface of the workpiece from separating away from the processing surface.

SUMMARY OF THE INVENTION

In order to achieve the above objects, a grinding method for a workpiece of the present invention comprises the steps of:

injecting abrasives together with compressed fluid to a processing surface 10 of the workpiece with an incident angle θ to meet the condition shown in the following equation:

$$0 < V \cdot \sin\theta \leqq \tfrac{1}{2} \cdot V \qquad \text{Equation 1:}$$

V=speed of the abrasive in the direction of injection

θ=incident angle of the abrasive to a processing surface of a workpiece, and generating a jet of the abrasives along the processing surface 10 of the workpiece (Corresponding to claim 1).

Herein the speed of the abrasives implies an averaging speed of the aggregation of abrasive grains, which are injected from an injection gun and each grain has a respective separate speed. In a round-shape gun F2-2A (made in Fuji Manufacturing Co., Ltd.), the speed distribution follows a normal distribution. In a Hyper gun (made in Fuji Manufacturing Co., Ltd.) composed of a slit-type injection gun, the speed distribution and the averaging speed of the abrasives are determined by the slit shape or the like.

And a jet guide means 30 of the present invention used for the above described grinding method comprises an inlet opening 31 which is arranged between an injection gun 20 and a processing surface 10 of a workpiece to be ground, and positioned ahead of the injection gun in the injection direction thereof to introduce a jet of abrasives injected from the injection gun 20, a guide path 33 formed in a predetermined curved shape to guide the jet introduced from the inlet opening 31, and an outlet opening 32 to discharge the jet of the abrasives guided through the guide path 33, wherein a shape of the guide path 33, and a relative position of the inlet opening 31 and the outlet opening 32 are set so that the abrasives discharged from the outlet opening 32 are injected to the processing surface 10 of the workpiece with an incident angle shown in the aforementioned Equation 1 (Corresponding to claim 7).

An injection regulation means 40 of the present invention used for the above method further comprises a regulation plate 41 which is located on a processing surface 10 of a workpiece to be ground to form a clearance between the regulation plate 41 and the processing surface 10 of the workpiece, wherein the clearance is large enough for introducing a jet of the abrasives injected together with the compressed fluid at an incident angle θ to meet the condition shown in the aforementioned Equation 1 so that, for example, the jet of said abrasives introduced between the processing surface of the workpiece and the regulation plate located on the processing surface.

OTHER DETAILED ASPECTS OF THE INVENTION

The present invention comprises the above described constitution and specific aspects as described below.

The incident angle is preferably 20° or less.

As shown in FIG. 15, which is described later, the reduction rate of surface roughness Ra is 55% at 30°, and over 60% at 20°, and 60% or more is improved in the roughness at 20°.

The reduction rate of Ra=1−Ra of injection angle θ/Ra of preliminary treatment surface.

Further, in said grinding method, a jet of the abrasives is introduced between the processing surface 10 of the workpiece and the regulation plate 41 located on the processing surface 10 (corresponding to claim 3).

In the above grinding method, the processing surface 10 of the workpiece at an incident position of the abrasives may be covered by a protector 60 (corresponding to claim 4).

Further, as described above, in the grinding method to introduce jet of abrasives between the regulation plate 41 and the processing surface 10 of a workpiece, a protector 60 to cover the processing surface 10 of the workpiece is disposed at the one end of the regulation plate 41, wherein the jet of the abrasives may be introduced between the protector 60 and the one end of the regulation plate 41 (corresponding to claim 5).

In the case of constant weight and flexibility of the regulation plate 41 and constant peripheral pressure thereof, the clearance between the regulation plate 41 and the processing surface 10 of the workpiece may be variable in accordance with the speed and pressure of the jet of abrasives to be introduced as an element to determine the clearance between the regulation plate 41 and the processing surface 10 (corresponding to claim 6).

The regulation plate 41 may be provided with an oblique portion 411 at one end thereof where the jet of the abrasives is introduced, wherein the one end of the regulation plate 41 is inclined in the direction away from the processing surface 10 of the workpiece (corresponding to claim 9).

A clearance retaining device such as a leg 43 mounted on a bottom of the regulation plate 41 may be disposed, wherein the clearance retaining device retains the clearance between the processing surface 10 of the workpiece and the regulation plate 41 in a predetermined range of 20 mm–2 mm, preferably 10 mm–2 mm or less (corresponding to claim 10).

The regulation plate 41 may be formed so that the clearance between the regulation plate 41 and the processing surface 10 of the workpiece is variable (corresponding to claim 11).

In order to vary the clearance between the regulation plate and the processing surface 10 of the workpiece, when the regulation plate 41 is made of flexible material, the flexible material is preferable for maintaining a clearance balanced by pressure and speed of the jet, pressure of a system, and a mechanical property of the flexible material (corresponding to claim 12).

The jet regulation means 40 constituted with the variable clearance system between the regulation plate and the processing surface 10 of the workpiece may be provided with an urging means which urges the regulation plate 41 on the processing surface 10 of the workpiece (corresponding to claim 13).

In addition, a protector 60 which covers the processing surface 10 of the workpiece may be disposed at one end of the regulation plate 41 where a jet of the abrasives is introduced so that a clearance through which the jet of the abrasives is introduced is disposed between the protector 60 and the regulation plate 41 (corresponding to claim 14).

BRIEF DESCRIPTION OF DRAWINGS

The objects and advantages of the invention will become apparent from the following detailed description of preferred embodiments thereof provided in connection with the accompanying drawings in which.

DETAILED DESCRIPTION OF THE PREFERRED EMBODIMENT

Embodiments of the present invention will be explained hereinafter.

As described above, satin finish formed on a surface of a workpiece by a blast processing prevent formation of a glossy surface. The formation of this unevenness shape of satin finish is supposed to be affected by the perpendicular direction speed of the abrasives to the processing surface of the workpiece among the speeds acting on the abrasives to be injected.

Figure 1:
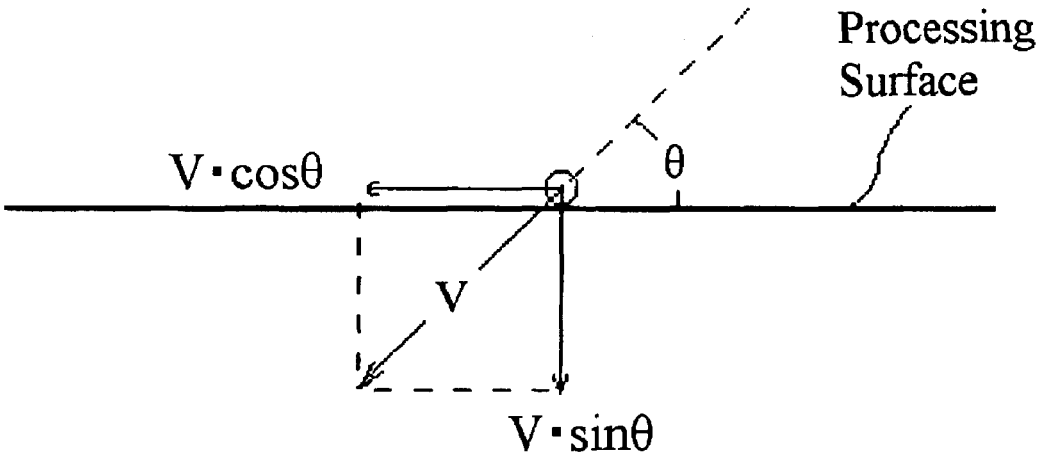
FIG. 1 is an explanation view of the grinding method of the present invention.

When abrasives are injected to the workpiece at a speed V and at an incident angle θ (angle formed by the injection direction and the processing surface of the workpiece) as shown in FIG. 1, the vertical speed acting in the direction perpendicular (90°) to the processing surface of the workpiece is $V \cdot \sin\theta$ and this vertical speed $V \cdot \sin\theta$ acts on the formation of satin finished surface to processing surface of the work piece.

According to the grinding method of the present invention, in the case of injecting the abrasives together with compressed fluid, the vertical speed $V \cdot \sin\theta$ to the processing surface is set as ½ or less of the speed V of the abrasives, namely an injection angle θ to the processing surface of the work piece is set at 30° or less, and thereby, a horizontal speed V·cos θ to the processing surface of the work piece is increased so as to be predominant sufficiently compared to the vertical speed V·sin θ and the satin finished surface formed on the surface of the work piece is reduced to a level where the satin finished surface does not affect formation of the glossy surface, or the satin finished surface is not formed, and moreover the increase of horizontal speed V·cos θ makes the injected abrasives travel in the horizontal direction (with reference to said vertical direction) on the processing surface of the work piece together with the compressed fluid, hence the processing surface of the work piece can be ground by the abrasives traveling in the horizontal direction to provide the glossy surface.

In addition, forming of the satin finished surface is more certainly restricted when smoother travel of the abrasives is performed in the horizontal direction, which results in obtaining a highly glossy processed surface. Accordingly grinding with the angle θ of 20°–0° is preferable for effective grinding so that the horizontal speed V·cos θ of the abrasives affecting the travel in the horizontal direction is predominantly increased over the vertical speed V·sin θ.

An incident angle of the compressed fluid together with the abrasives to the processing surface 10 of the work piece was determined by the experiment example 1 as follows.

Test Example 1

TABLE 1

| Processing Condition | |
|---|---|
| WORKPIECE | SODA GLASS 150 mm × 150 mm THICKNESS OF 3 MM |
| BLAST PROCESSING DEVICE | SGF-4 (made in Fuji Manufacturing Co., Ltd.) |
| INJECTION GUN | F2-2A (made in Fuji Manufacturing Co., Ltd.) |
| ABRASIVE | FUJIRUNDUM C (CARBORUNDUM) #220 (made in Fuji Manufacturing Co., Ltd.) |
| INJECTION PRESSURE | 0.4 MPa |
| DISTANCE BETWEEN GUN AND WORKPIECE (INJECTION DISTANCE) | 100 mm |

Processing Method

Fixing base of the workpiece glass was arranged in rotatable manner so that any discretional angle θ of the incident angle between the workpiece and the abrasives could be obtained while the abrasive injection gun was fixed.

Before commencing the processing at an angle θ, the abrasives are injected to the surface of glass as the workpiece at an injection pressure of 0.4 MPa and an injection angle of 90° for 60 sec. as a preliminary treatment to make the entire surface be the satin finished surface (the surface where the preliminary treatment is performed is called a preliminary treatment surface).

Next, the workpiece was fixed on a rotational base and was set to a discretional injection angle θ. The clearance (distance) between an injection opening of the gun and the workpiece was set as 100 mm.

The injection angle (θ shown in FIG. 1) was set as 90° (vertical incidence), 45°, 30°, 20°, 15°, 10°, and 5°.

The surface roughness of the workpiece processed by injection is measured by using a SURFCOM 1400A (made in TOKYO SEIMITSU CO., LTD.). The measurement condition: measurement length: 4.0 mm, cutoff wave length: 0.8 mm, measurement speed: 0.3 mm/sec.

The surface roughness was measured at 15 mm downstream of the injection jet from the injection point to remove the influence that the workpiece was intensely processed at the injection point.

The surface roughness Ra (μm) on the preliminary treatment surface of the workpiece to which the various angle processing was to be performed was 2.671 μm.

Figure 14:
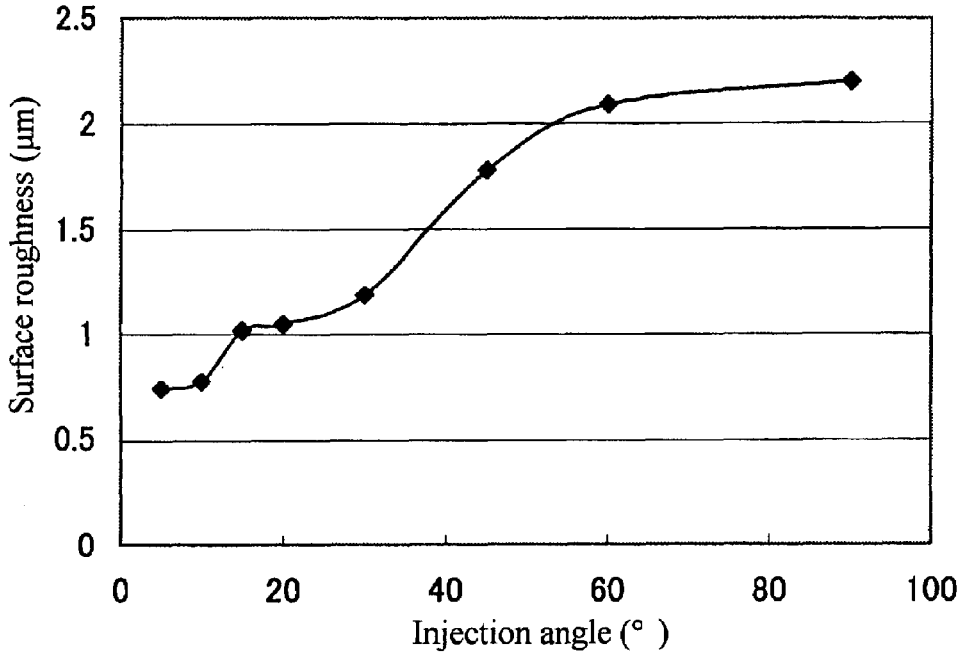
FIG. 14 is a graph showing a relationship between an injection angle and a surface roughness.

The injection angle and the surface roughness Ra (μm) are shown in FIG. 14. The surface roughness Ra is reduced with changing angles from high angle 90° to low angle 5°.

Figure 15:
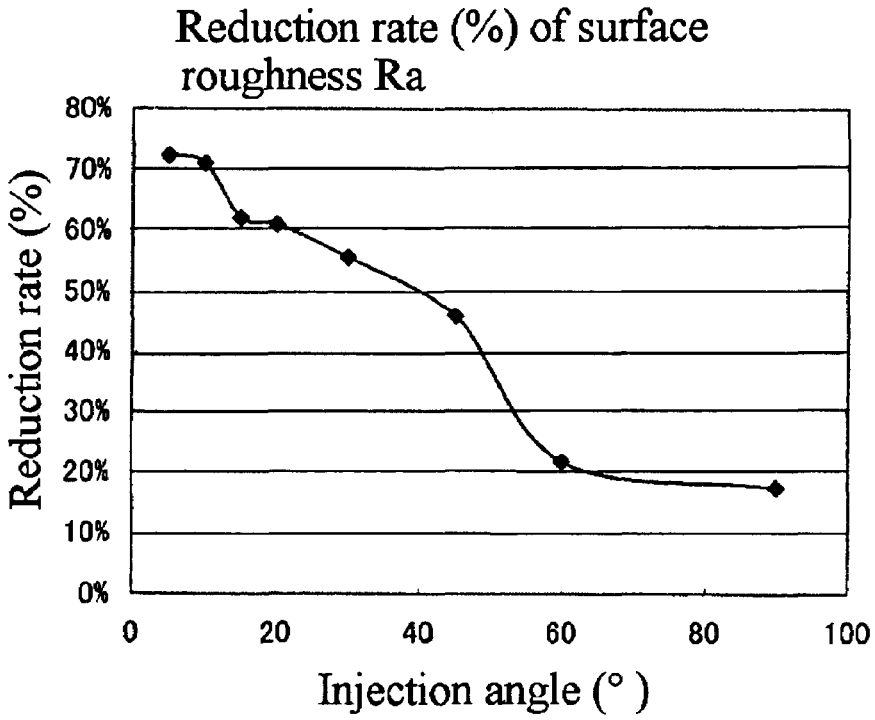
FIG. 15 is a graph showing a relationship between an injection angle and a surface roughness reduction rate.

Reduction rate of Ra for each injection angle with reference to the surface roughness on the preliminary treatment surface of the workpiece is shown in FIG. 15.

Reduction rate of surface roughness Ra=(1−Ra of injection angle θ/Ra of preliminary treatment surface).

In FIG. 15, the reduction rate of Ra is larger at lower angles of an injection angle of 45°–50° than at higher angles of 90°, 60°. The reduction rate of surface roughness Ra is increased from 45% to over 70% with the smaller injection angle than about 45° with reference to Ra of the preliminary treatment surface, consequently, the grinding effect of this processing method has been confirmed.

The reduction rate of surface roughness Ra of 50% or more is considered to be the judgment of effectiveness of the processing method. According to the judgment, this effect is obtained at the vicinity of injection angle 40°. Accordingly on the condition of $\theta < V \cdot \sin\theta \leqq \frac{1}{2} \cdot V$, the reduction rate of Ra becomes 50% or more. Further it is preferable that the injection angle is 20° or less where the reduction rate of the surface roughness Ra is 60% or more.

Injection Method of Abrasive

As described above, the injection of abrasives to generate a jet of the abrasives along the processing surface of the workpiece can be performed by various known blast processing devices in which the abrasives are accelerated by the compressed fluid and injected, and this blast processing device may be either of a dry type or a wet type as long as it injects abrasives with compressed fluid.

As compressed fluid to accelerate the abrasives, any of gas, liquid, and a mixture thereof may be used. In the case of using, for example, a gas as the compressed fluid, compressed air and other compressed gases such as hydrogen gas, argon gas, or carbon dioxide may be used. These compressed gases may be used separately or by mixing them.

The injection pressure of the compressed gas is sufficient if the abrasives are provided with desired velocity energies when the abrasives are injected by the gun and can be selected out of diversified ranges depending upon various conditions such as a target gloss level of the processed surface, material property of the abrasives and the workpiece to be used or the others. It is not limited to a particular range as long as it can control the injection energy at more than an atmosphere pressure. As one example in the embodiment, the compressed gas having pressure of 0.1 MPa–1.5 MPa is used.

And adherence of the abrasives caused by electrical charge may be prevented by mixing an antistatic additive or a surface-active agent with the compressed gas as injection fluid.

Workpiece

A grinding method of the present invention includes various workpieces such as inorganic materials of metals, glass, ceramics or the like, or synthetic resins such as plastics or the like, other resins, lumber, rock, or others as a grinding object.

In particular, according to the present invention, grinding can be performed without applying pressure to the processing surface 10. Therefore, processing distortions caused by the grinding are unlikely to occur. Accordingly, even in the case of grinding the workpiece such as a silicon wafer requiring perfect crystal at the surface vicinity thereof, the grinding is properly performed eliminating heat treatment or removal of the surface layer by acid or alkali or the like after the grinding.

Since occurrence of the micro cracks is prevented, grinding the workpiece such as quartz, sapphire, glass or the like made of hard, fragile material can be performed without occurrence of the micro cracks.

In addition, since the abrasives injected with the compressed fluid, namely, the jet of the abrasives flows along the processing surface 10 even if the processing surface is curved, the workpiece as a grinding object is not limited to the processing surface having a flat shape, but also the grinding can be properly performed for a workpiece the surface of which has uneveness such as a mold tool, an electrode of a fuel cell and for a workpiece the surface of which has a curved surface such as a piston and a cylinder for an internal combustion engine.

Abrasives

The abrasives to be used do not require a specific structure and various known abrasives can be used. One abrasive or a mixture of two or more selected out of the abrasives shown in the following table can be used depending on material property of a workpiece, a target grinding condition or the like of a workpiece.

Also a grain size and a shape of the abrasives to be used can be properly varied depending on the purpose of the processing or the processing condition such as a material property of a workpiece or the purpose of the grinding (for example, the level of the gloss or the level of the surface roughness to be obtained on the processed surface). The grain size can be in the range of from about 0.5 mm to #30000 (5.0 μm, average diameter of the largest grain: 19 μm or less, average of average grain size: 5.9–4.7 μm) and the shape can be, not only a spherical form but various forms which are generally called shot/grid/cut wire/round cut wire including polygon, column and flake. The size or the grain size is not limited specifically but can be changed properly.

TABLE 2

| Material Property of Abrasive | |
|---|---|
| RESIN | NYRON, POLYCARBONATE, POLYETHYLENE, POLYPROPYLENE, POLYSTYRENE, CHLOROETHENE, POLYMETHYLMETHACRYL, POLYACETAL, ACCETYL CELLULOSE. |
| PLANT | CORE OF CORN, WALNUT, APRICOT, NUT, SEEDSHELL OF PEACH, PULP, CORK |
| GLASS | GLASS, HARD GLASS |
| METAL | IRON, STEEL, CAST IRON, COBALT, NICKEL GALLIUM, ZIRCONIUM, NIOBIUM, MOLYBDENUM, RHODIUM, PALLADIUM, SILVER, INDIUM, TIN, ANTIMONY,ZINC |
| CERAMICS | STAINLESS, TITANIUM, VANADIUM, CHROME, ALMINUM, SILICON, COPPER, $MnO_2$, $Cr_2O_2$ AND THEIR ALLOY, ZIRCONIA, GARNET, EMERY, ALUNDUM, WHITE ALUNDUM |
| INORGANIC | CARBONATE/SULFATE SALT/FLUORIDE OF CALCIUM, SULFATE SALT/CHLORIDE SALT OF BARIUM, SULFATE SALT/HYDROXIDE OF ALMINUM, CARBONATE/SULFATE SALT/ CHLORIDE SALT OF STRONTIUM, TITANIUM OXIDE, BASIC MAGNESIUM CARBONATE, MAGNESIUM HYDROXIDE, CARBON, GRAPHITE, MOLYBDENUM SULFIDE, TUNGSTEN SULFIDE |

Adjustment of Injection Angle to Workpiece

Figure 2:
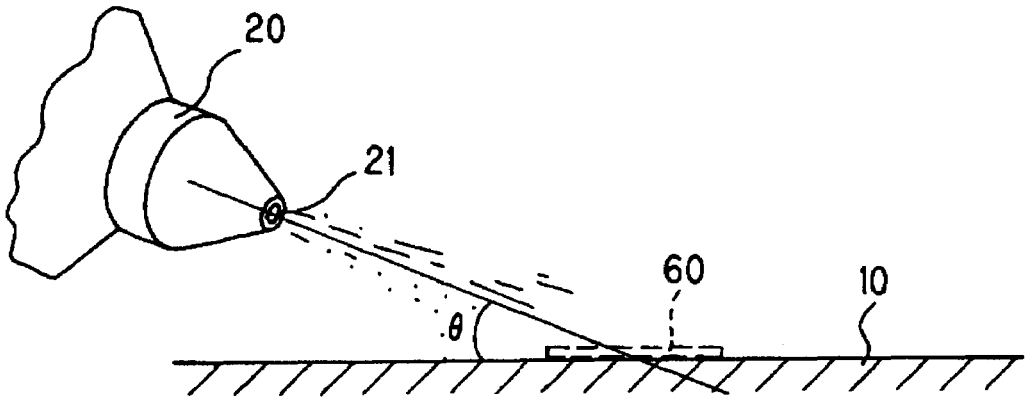
FIG. 2 is a perspective view showing one example of an injection method of abrasives where an injection is performed directly to a workpiece by an injection gun.

With respect to an adjustment of an incident angle of the abrasives to the processing surface 10 of the workpiece, as shown in FIG. 2, the injection gun 20 disposed in the known blast processing device is inclined to the processing surface 10 of the workpiece at 30°–0°, preferably 20°–0° or the processing surface 10 of the workpiece is inclined to the injection direction of the injection gun 20 of the above angles. Thus a relative position between the injection direction of the abrasives by the injection gun 20 and the processing surface of the workpiece may be arranged so that the abrasives are injected at the above angles.

In this case, when the abrasives are injected with an angle to the processing surface 10 of the workpiece, a protector 60 is disposed to cover the processing surface 10 of the workpiece at an incident position of the abrasives, to prevent the abrasives with the vertical speed from directly contacting the processing surface 10 of the workpiece, accordingly the workpiece may be ground by the jet of the abrasives which has been guided to flow along the processing surface 10 of the workpiece after collision with the protector 60.

Figure 3:
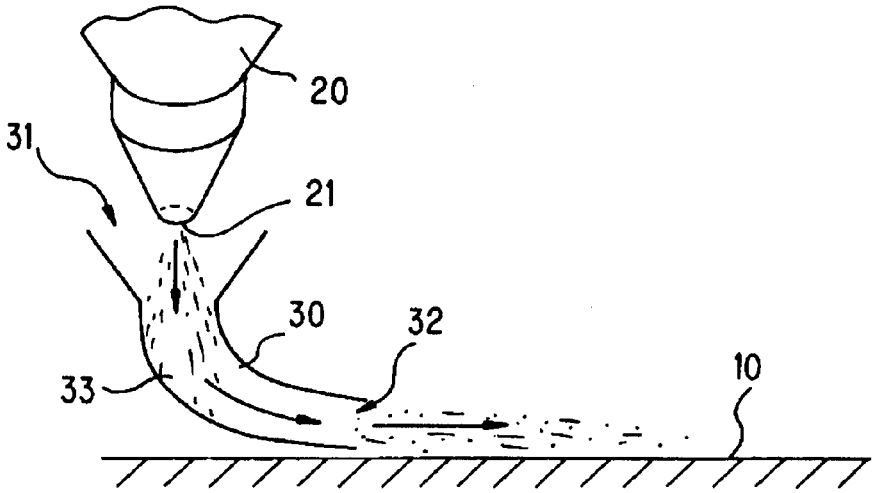
FIG. 3 is a perspective view showing one example of an injection method of the abrasives where an injection is performed by using a jet guide means.

Further, an adjustment of an incident angle of the abrasives to the processing surface of the workpiece, as the embodiment shown in FIG. 3, may be performed without change of the location of the injection gun 20 or the workpiece by a jet guide means 30 which guides a jet of the abrasives injected by the injection gun 20 to have a predetermined incident angle to the processing surface 10 of the workpiece.

In the embodiment shown in FIG. 3, the jet guide means 30 is constructed of substantially a tube curved at a predetermined angle and introduces the jet of the abrasives injected from the injection gun 20 through the inlet opening 31 disposed at one end of the jet guide means 30, and this introduced jet of the abrasives is guided in a predetermined direction in a guide path 33 formed in the curved portion. Thereafter, the jet is injected toward the processing surface 10 of the workpiece through the outlet opening 32 disposed at the other end of the jet guide means 30.

In the embodiment shown in the drawing, the jet guide means 30 is provided with a L-shaped guide path 33 curved at about 90° to guide the jet of the abrasives injected from the injection gun 20 located perpendicular to the processing surface 10 of the workpiece to flow in parallel with the processing surface 10 of the workpiece.

The inlet opening 31 to which the jet of the abrasives injected from the injection gun 20 is introduced is formed in an inverted cone shape with the opening formed larger in diameter than the other portions, so that the jet of the abrasives injected from the injection gun 20 is arranged to be properly introduced inside the jet guide means 30.

Although the jet guide means 30 is described above to be cylindrical, the jet guide means 30 is not limited to the shown embodiment as long as it can guide the jet of the abrasives injected from the injection gun 20 to advance in a predetermined direction, but for example, may be formed of a tube with a rectangular cross section in the width direction.

A shape of the guide path 33 through which the abrasives pass may be varied in the length direction of the jet guide means 30. For example, the width of the guide path 33 is enlarged and the height is reduced toward the outlet opening 32 to form a slit shape outlet opening 32 so that the jet injection of the abrasives on the relatively broad region of the processing surface of the workpiece is obtainable, and the jet guide means 30 may be varied in size in accordance with a size of the injection gun 20 to be used.

When the jet of the abrasives injected from the injection gun 20 is injected toward the inlet opening 31 of the jet guide means 30 as constituted above, the jet of the abrasives introduced from the inlet opening 31 is guided inside the guide path 33 formed inside the jet guide means 30, and the jet is injected from the outlet opening 32 at an injection angle of 30°–0°, preferably 20°–0°0, more preferably substantially in parallel to the processing surface 10 of the workpiece.

Thus when the jet of the abrasives guided at a predetermined angle is injected through the outlet opening 32 to the processing surface 10 of the workpiece, this injected jet of the abrasives flows substantially in parallel with the processing surface 10 of the workpiece, so that the workpiece is cut by the abrasives substantially in parallel with the processing surface, to grind the surface without forming a satin-finished surface.

In particular, when the injection of the abrasives is made directly toward the processing surface 10 of the workpiece by the injection gun 20, there is a case where it is difficult to make the incident angle θ of the jet close to 0° due to restriction of the shape of the injection gun 20, but when the jet guide means 30 formed as described above is used, it has an advantage that the jet can be guided in the direction in parallel with the processing surface 10 of the workpiece without being subjected to the restriction based upon the shape of the injection gun 20.

Regulation of Jet As described above, it is preferable to regulate the flow of the jet so that the jet of the abrasives injected to the processing surface 10 of the workpiece at a predetermined angle is prevented from separating from the processing surface 10 of the workpiece, and the jet of abrasives travels on the processing surface 10 of the workpiece at the high density. A jet regulation means 40 can be disposed as shown in FIG. 4–FIG. 13 as the device that thus regulates the jet of the abrasives.

The jet regulation means 40 is provided with a regulation plate 41 located with a predetermined clearance from the processing surface 10 of the workpiece, and the jet of the abrasives injected through an injection opening 21 of the injection gun 20 is introduced between the processing surface 10 of the workpiece and the regulation plate 41. Thereby it is prevented that the jet of the abrasives diffuses in the direction to separate the jet from the processing surface 10 of the workpiece, so that the jet of the abrasives travels securely with a predetermined clearance from the processing surface 10 of the workpiece, to keep an abrasive density in the jet to be very high, as well as to be constant.

Figure 4:
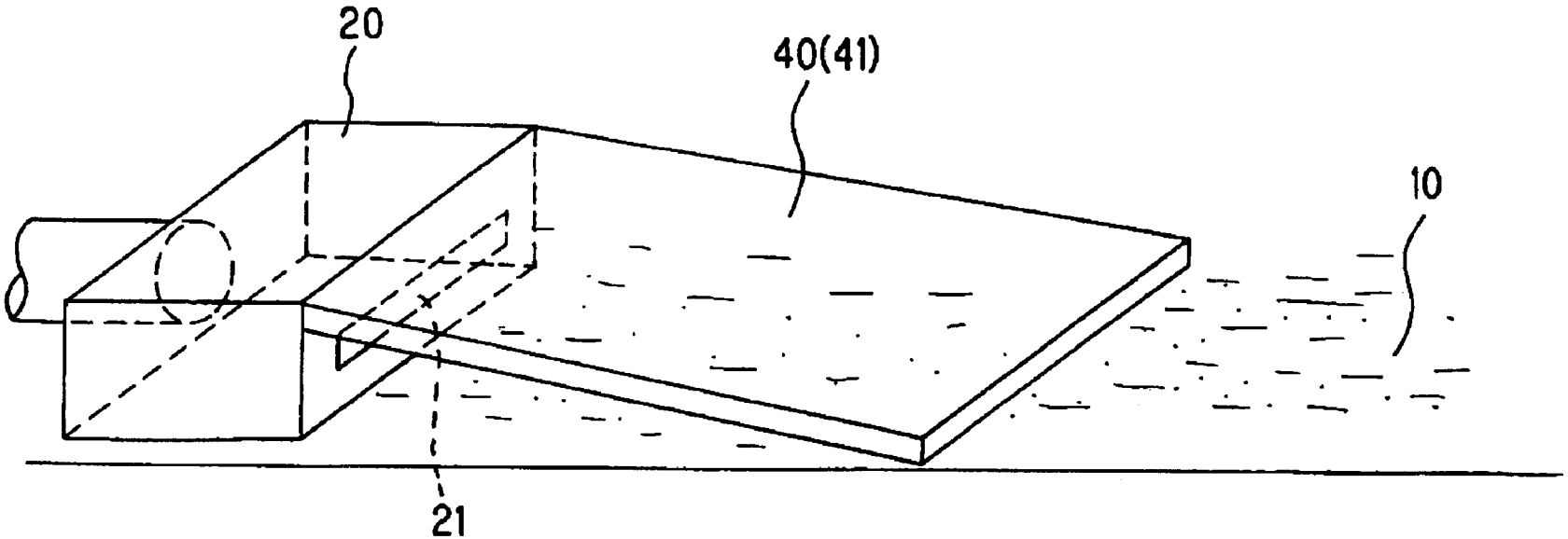
FIG. 4 is a perspective view showing an embodiment of a jet regulation means.

FIG. 4 shows an embodiment where such jet regulation means 40 (regulation plate 41) is mounted to the injection gun 20 and an injection opening 21 of the injection gun 20 is opened between the regulation plate 41 and the processing surface 10 of the workpiece, so that the jet of the abrasives injected from the injection gun 20 is arranged to be introduced in the clearance between the processing surface 10 of the workpiece and the regulation plate 41.

The regulation plate 41 is formed in a flat oblong (rectangular) shape in the embodiment shown herein, but this shape is not limited to the embodiment as shown in drawings, and may be square, trapezoid, the other polygon, round, ellipse and the like. In case the processing surface of the workpiece has the concave and convex surface, the surface of the regulation plate 41 opposing the processing surface 10 of the workpiece may be formed in the uneven shape which corresponds to this uneven shape, and the shape may be formed by combining these shapes and is not limited to the embodiment shown in drawings.

Various materials can be used for the jet regulation means 40 (regulation plate 41 in the embodiment shown in FIG. 4) as long as the material is strong enough to endure pressure/speed energies of the jet of the abrasives, and various material properties or thicknesses of the jet regulation means 40 can be selected depending on the material property, the grain size, speed of the jet, and the endurance of the abrasives, and the thickness is in the range of from 0.5 mm–15 mm, preferably from 1 mm–10 mm in consideration of working endurance, durability against the grinding conditions, depending on the material property, though.

Examples of usable metallic material as the jet regulation means 40 (regulation plate 41) are metals such as aluminum, silicon, titanium, vanadium, chrome, manganese, iron, cobalt, nickel, copper, gallium, germanium, selenium, strontium, yttrium, zirconium, niobium, molybdenum, rhodium, palladium, silver, cadmium, indium, tin, tellurium, neodymium, an alloy containing one or more of these metals, oxide thereof, or cemented carbide such as WC, TiC or the like.

Furthermore, ceramics, glass, quartz, alumina, mullite, zirconia, zircon, mica ceramics, silicon nitride, silicon carbide, PZT (lead zirconate titanate), barium titanate, graphite, carbon fiber, boronniteride, diamond and the like may be used as raw materials for the jet regulation means 40.

In the case of manufacturing the jet regulation means (regulation plate) with a resin material such as plastics, the resin material to be used may be any of thermosetting resin or thermoplastic resin, and phenol resin, urea resin, melamine resin, polyester resin, silicon resin, polyurethane resin, vinyl chloride, vinylidene chloride, styrol polyamide resin, polyethyle resin, acrylic resin, fluorocarbon resin, cellulose plastic, polypropylene or the like can be used.

And the jet regulation means 40 (regulation plate 41) may be formed of rubber, for example, natural rubber, Buna (S), Buna (N), polychloroprene (neoprene: trade mark) as butadiene synthetic rubber, thiokol (A), thiokon (B) as resilient material of polysulfide, or the like.

Further, the jet regulation means 40 may be formed by combining a plurality of plates made of these materials or by combining these materials with other materials, and, for example, an improvement of strength thereof may be obtained by combining a glass fiber with plastic. And the laminated structure of a metal and urethane may be used and preferably a tool steel, ceramics, a hard metal, boron nitride, or the like may be used to establish high endurance to the jet of the abrasives.

And the clearance between the regulation plate 41 of the jet regulation means 40 and the processing surface 10 of the workpiece is in the range of from 20 mm–2 mm, preferably 10 mm–2 mm.

TEST EXAMPLE 2

The clearance between the regulation plate to regulate a jet flow of abrasives referring to the processing surface 10 of the workpiece and the processing surface 10 of the workpiece was determined by the following test.

TABLE 3

| Processing Condition | |
|---|---|
| WORKPIECE | SODA GLASS 150 mm × 150 mm THICKNESS OF 3 mm |
| BLAST PROCESSING DEVICE | SGF-4 (made in Fuji Manufacturing Co., Ltd.) |
| INJECTION GUN | F2-2A (made in Fuji Manufacturing Co., Ltd.) |
| ABRASIVE | FUJIRUNDUM C (CARBORUNDUM), #220 (made in Fuji Manufacturing Co., Ltd.) |
| INJECTION PRESSURE | 0.4 MPa |
| PROCESS TIME | 120 seconds |

Regulation Plate

Figure 6:
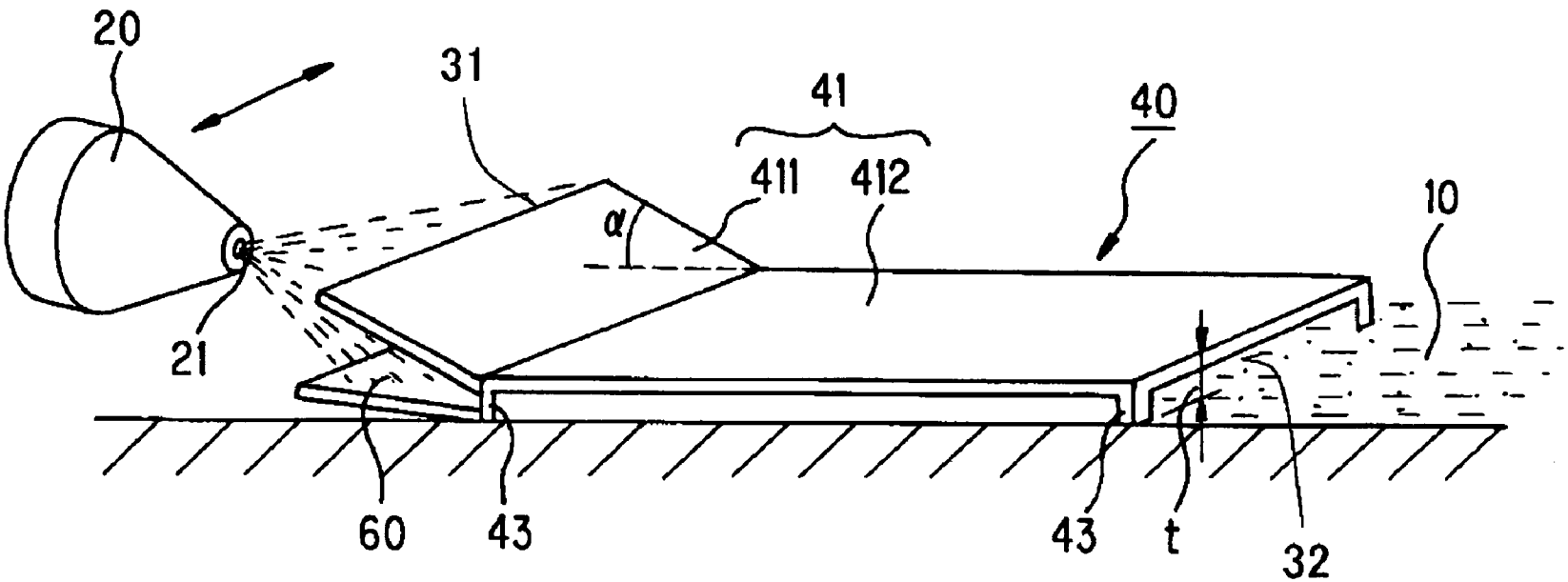
FIG. 6 is a perspective view showing a different embodiment of a jet regulation means.

A regulation plate shown in FIG. 6 is used.

The body of the regulation plate having 120 mm in longitudinal length, 120 mm in widthwise length, 10 mm in height, 5 mm in thickness, is made of SUS304. The height H where the jet flows is adjusted by a side plate to be 3 mm, 5 mm, 10 mm, 20 mm, 40 mm (Height H means a clearance between the top of the regulation plate and the processing surface of the workpiece).

The protector is formed of SUS304 plate of 2 mm in thickness, and the injection gun is fixed and inclined at about 30° to the processing surface of the workpiece for grinding by injection. The grind processing is performed according to this method, changing successively the clearance between the regulation plate and the processing surface 10 of the workpiece.

Measurement of Surface Roughness Ra

A surface roughness of the processing surface 10 was measured by Surfcom1400A (made in TOKYO SEIMITSU CO., LTD.) on an injection axis of the injection gun at 20 mm inside from the regulation plate outlet.

The measurement condition: 4.0 mm long for measurement, 0.8 mm cutoff wave length, 0.3 mm/sec of measurement speed.

The abrasives were injected to the workpiece as a preliminary treatment at an injection angle of 90° to make a satin finished surface.

The surface roughness Ra was 2.671 μm.

The display is a reduction rate (1−surface roughness Ra at clearance H/Ra of preliminary treatment surface) of the surface roughness Ra preliminary-treated.

Figure 16:
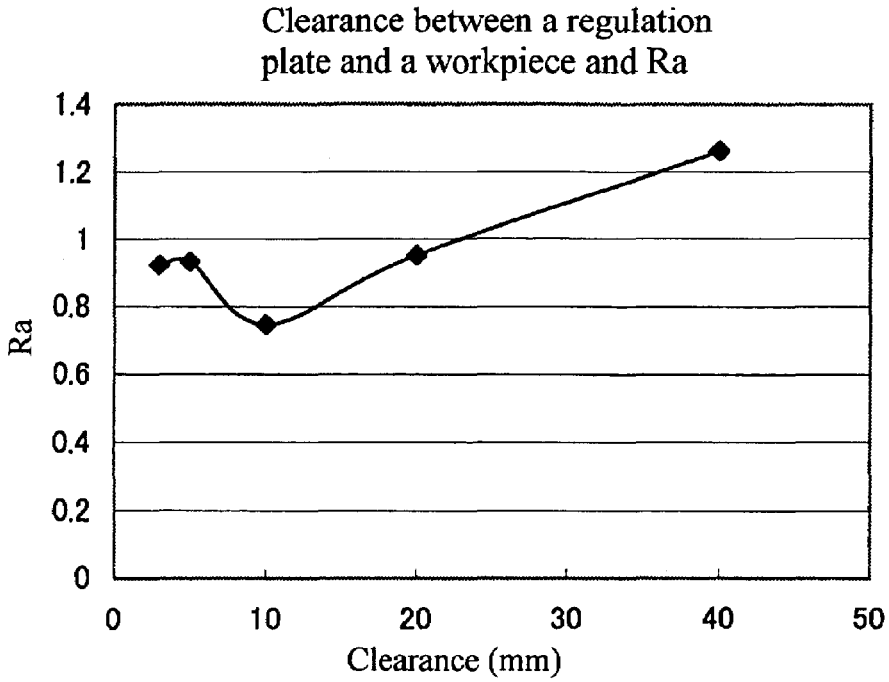
FIG. 16 is a graph showing the result of Ra in a position of X=0 mm.

FIG. 16 shows the result of Ra at a location of X=0 mm.

Figure 17:
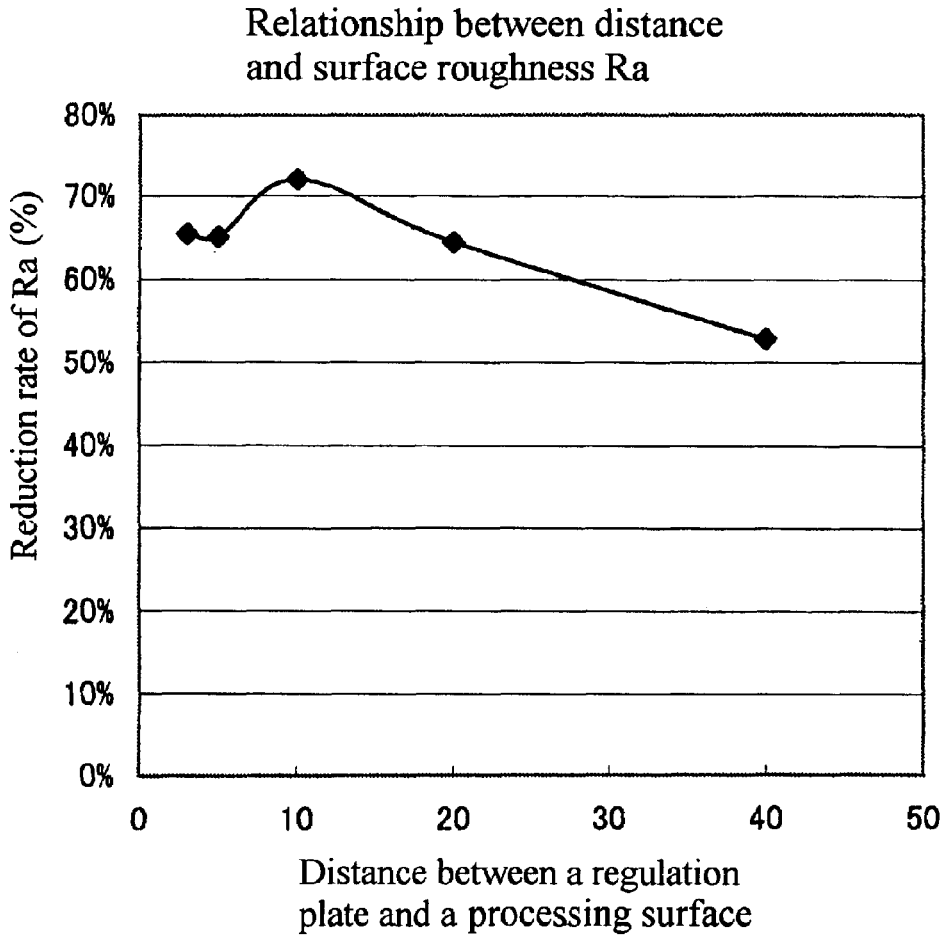
FIG. 17 is a graph showing the reduction rate of Ra in a position of X=0 mm;.

FIG. 17 shows the reduction rate of Ra at a location of X=0 mm.

According to FIG. 16 and FIG. 17, the effect of the regulation is confirmed from the result that the surface roughness Ra is largely improved from Ra=2.671 μm of the preliminary treatment product in the range of the clearance from 3 mm–40 mm where the experiment has been carried out using the regulation plate. Even in the clearance of 40 mm, an improvement of Ra (reduction rate) is 50% or more.

The reduction rate of Ra in the surface direction was measured at a position of X=10 mm and the reduction rate were as follows. In case an injection axis of the injection gun is Y axis, a measurement point of X=0 mm is to be the position 20 mm inside of the regulation plate outlet (guiding outlet 32) on Y axis as the injection axis. A position of X=10 mm is a position of X=10 mm on X axis perpendicular to Y axis. The grinding effect at a position apart from the Y axis, which was the injection axis, was evaluated by this measurement.

Figure 18:
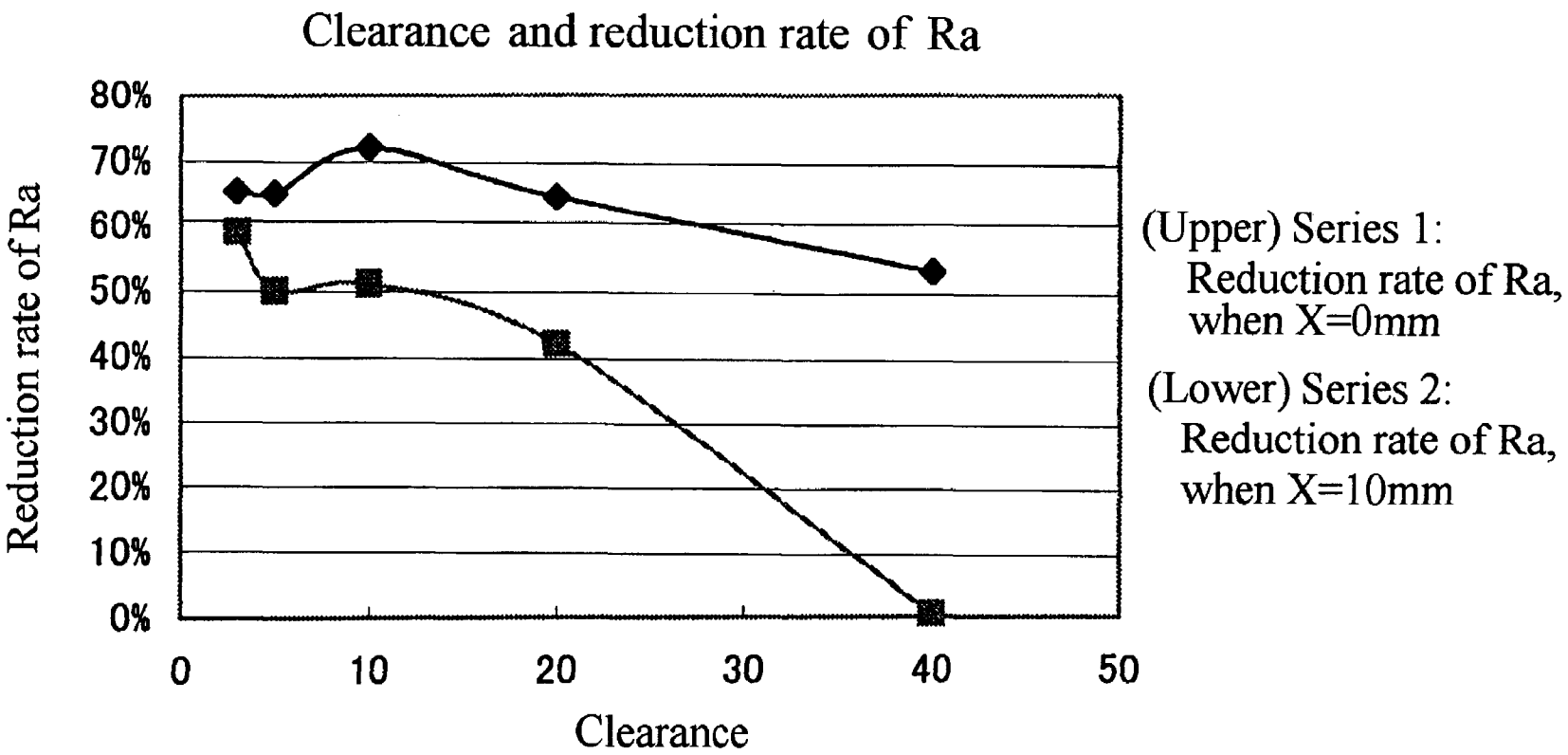
FIG. 18 is a graph showing the reduction rate of Ra in a position of X=0 mm and 10 mm.

FIG. 18 shows reduction rate of Ra at X=0 mm, 10 mm.

It is confirmed that the effect of the grinding is reduced as the measurement point goes away from the injection axis. It is understood that the reduction rate decreased more as the clearance becomes larger.

It is required to regulate the clearance and to improve reduction rate of Ra at a unit time, namely, improve the grinding effect for speeding up the grinding in the interest of efficiency.

When at X=0 mm, the reduction rate of Ra is 60% or more, and at X=10 mm, the reduction rate of Ra is 40% or more with the clearance of 20 mm or less. It is preferable that the clearance is set as less than 10 mm where the reduction rate is 50% with X=0 mm and X=10 mm.

The lower limit of the clearance is not limited as long as the injection jet is stably injected, but considering the point of easy handling without damage on the workpiece due to contacting therewith when an inflexible regulation plate is used, the lower limit is to be 2 mm based upon the result of the embodiment and urethane regulation plate.

Figure 19:
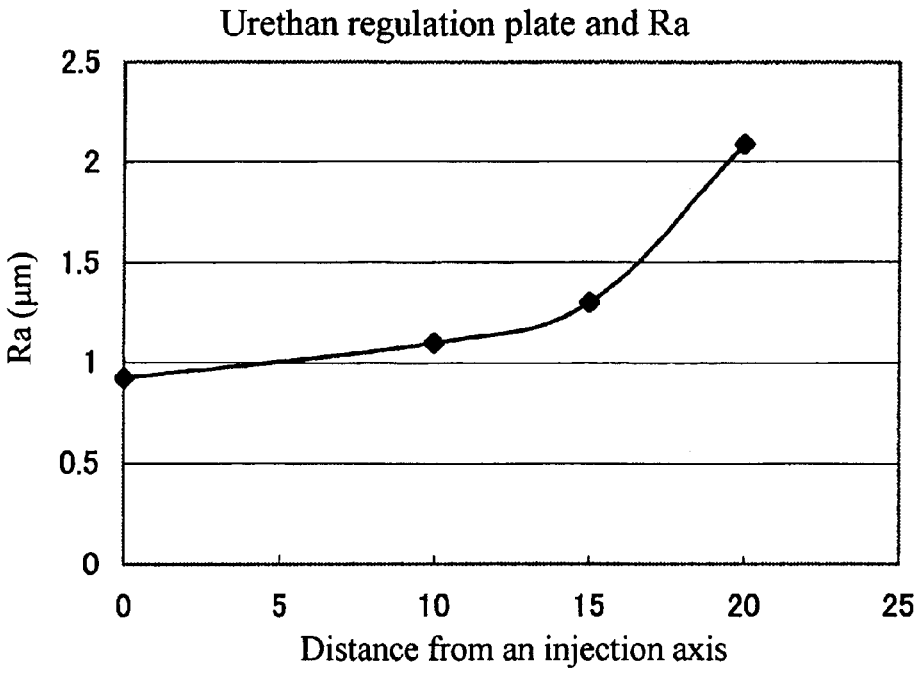
FIG. 19 is a graph showing a surface roughness Ra with a distance Xmm from an injection axis (urethane regulation plate)

FIG. 19 shows the regulation result by a flexible regulation plate.

The processing condition was the same as the above condition.

The protector contacted the workpiece and the regulation plate was held at a position horizontal to the processing surface of the workpiece. The injection gun injected at 20° to the horizontal. Thereby the regulation plate stably floated, to provide the clearance of 2 mm between the regulation plate and the processing surface of the workpiece at an exit of the jet end. The regulation plate was formed in a balanced shape with the material in response to an injection amount, speed and pressure.

TABLE 4

| Regulation Panel | |
|---|---|
| MATERIAL PROPERTY | URETHANE RUBBER SHEET TYPLANE UL (Tigers Polymer Corporation) |
| SHAPE/SIZE | TRAPEZOID, 70 mm TOP SIDE WIDTH, 130 mm BOTTOM WIDTH, 150 mm LONG, 2 mm THICK |
| PROTECTION SHEET/ MATERIAL PROPERTY | SAME WITH REGULATION PLATE |
| SHAPE, SIZE | RECTANGLE, 50 mm WIDE, 120 mm LONG, 2 mm THICK |

A top side of the rectangular regulation plate was fixed on the chip holder of the injection gun F2-2A (made in Fuji Manufacturing Co., Ltd.) by a vinyl tape. The regulation plate was fixed so that a longitudinal direction of the rectangle is substantially in conformity with the injection axis of the injection gun. The shore side of the protector was fixed to the gun chip holder in the same way.

Measurement Position of Surface Roughness Ra

The measurement was carried out at a position of X=10 mm, 15 m, 20 mm, 40 mm when a point on the injection axis that was 20 mm inside of the outlet opening 32 of the regulation plate is set as X=0 mm.

Result

Figure 20:
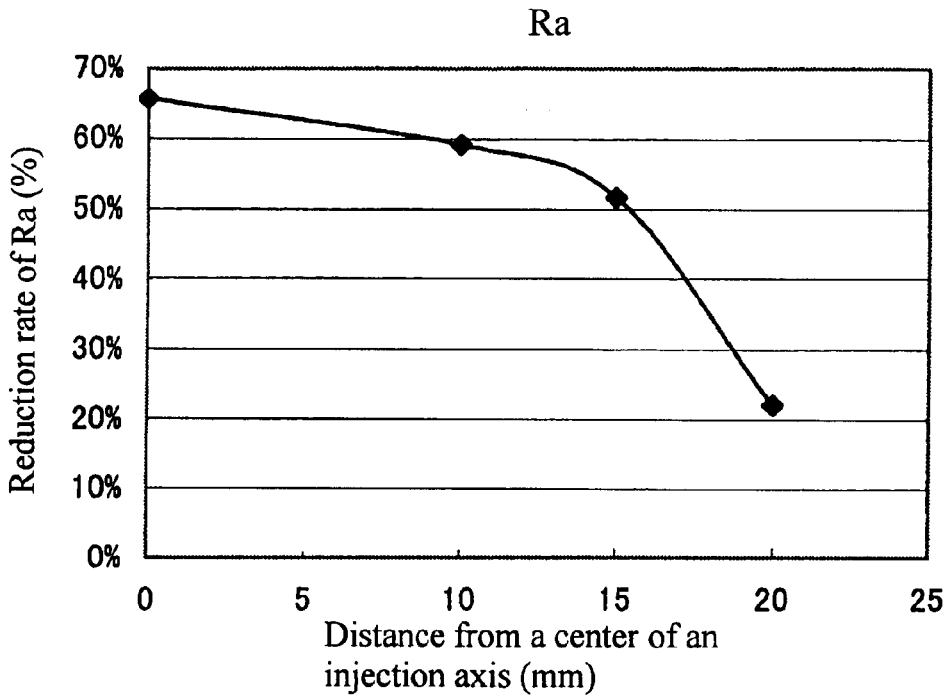
FIG. 20 is a graph showing reduction rate of surface roughness with a distance Xmm from a center of an injection axis.
Figure 21:
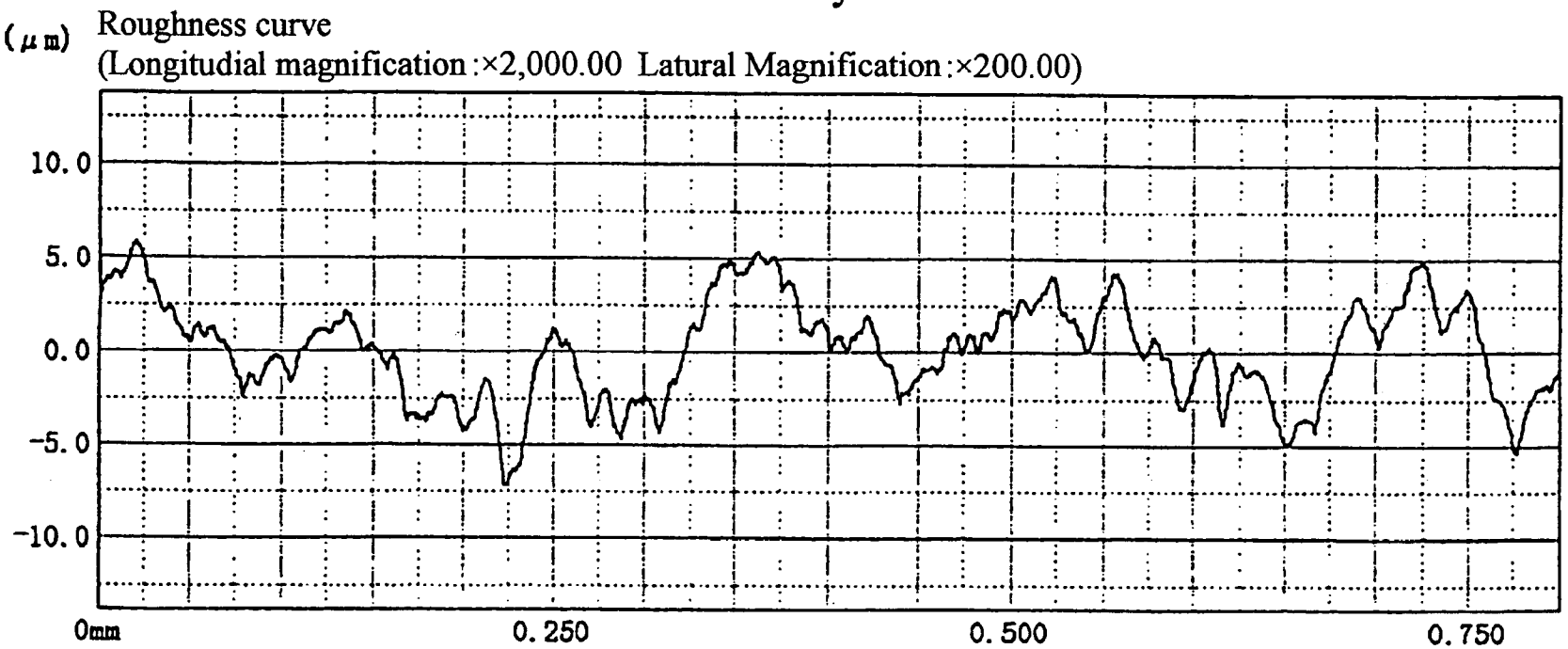
FIG. 21 is a graph showing roughness curve at a preliminary treatment (injection angle of 90°)
Figure 22A:
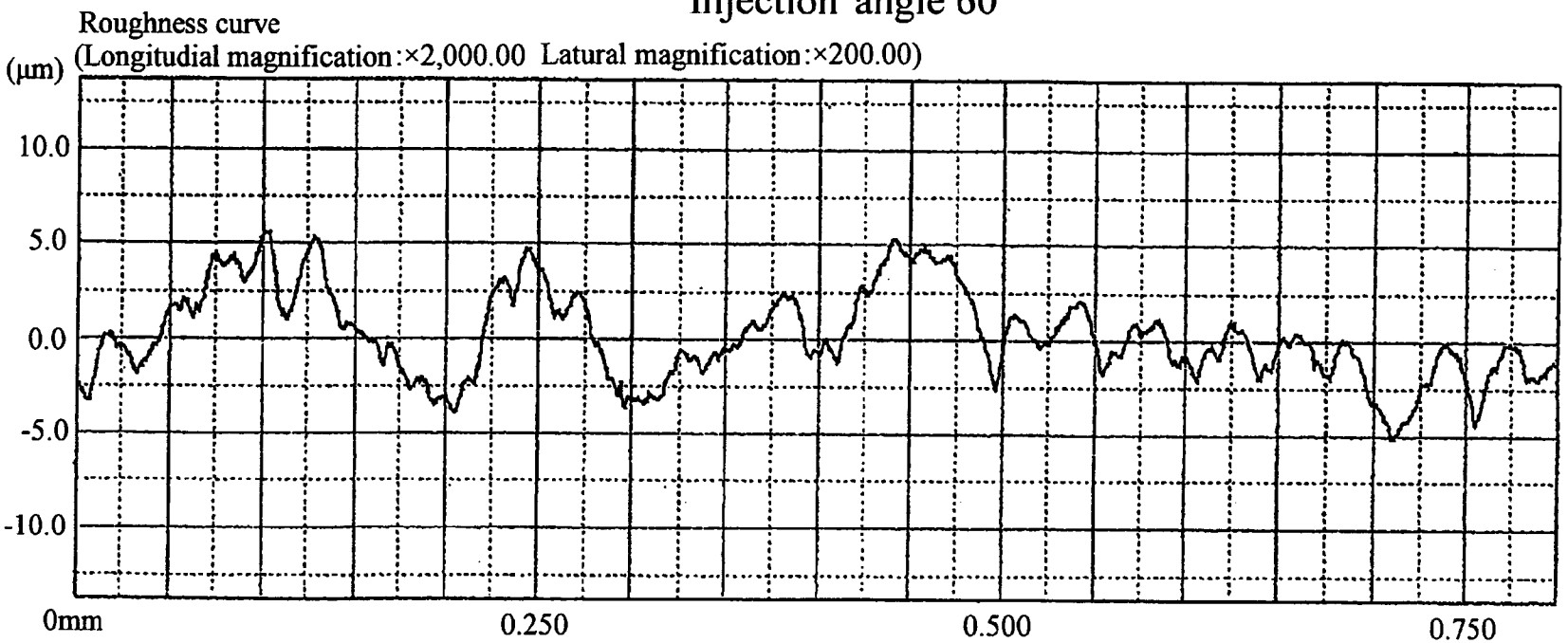
FIG. 22 is a graph showing a roughness curve, wherein (A)–(D) respectively show the roughness curve with an injection angle of 60°, 30°, 20°, and 5°.
Figure 22B:
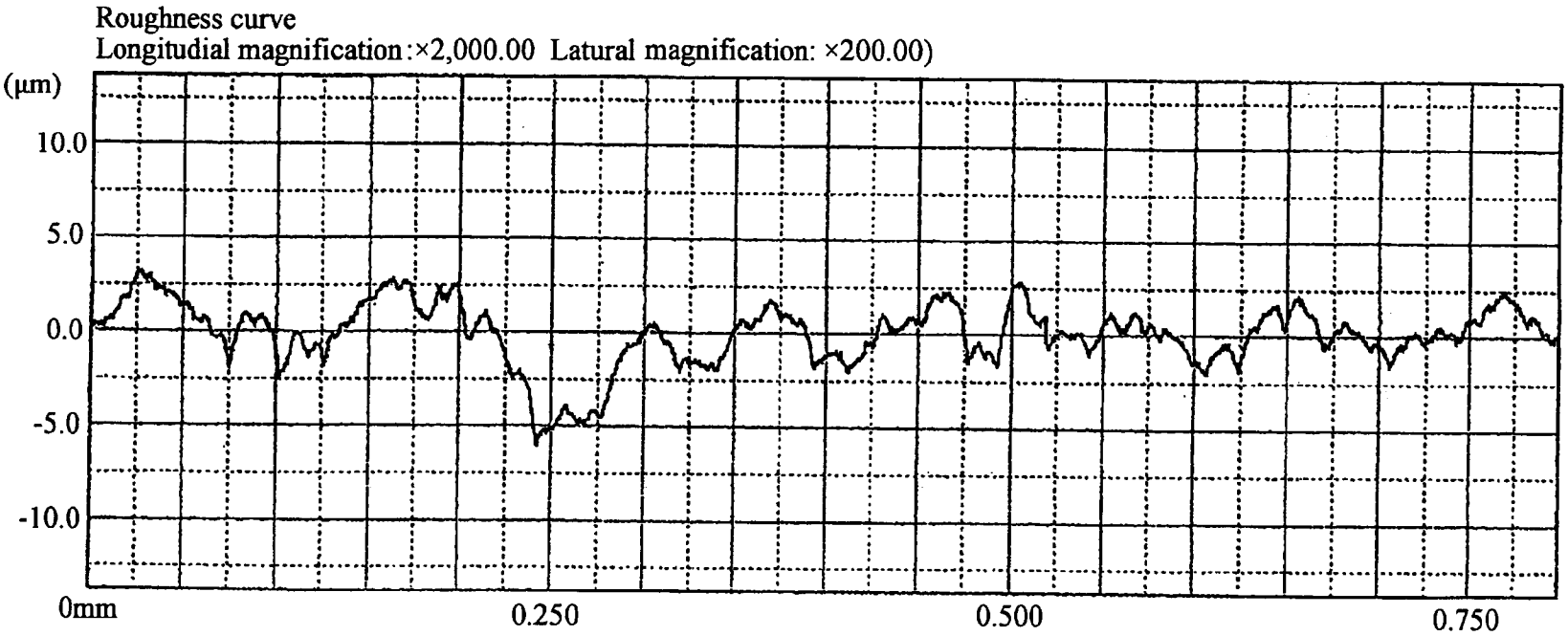
Figure 22C:
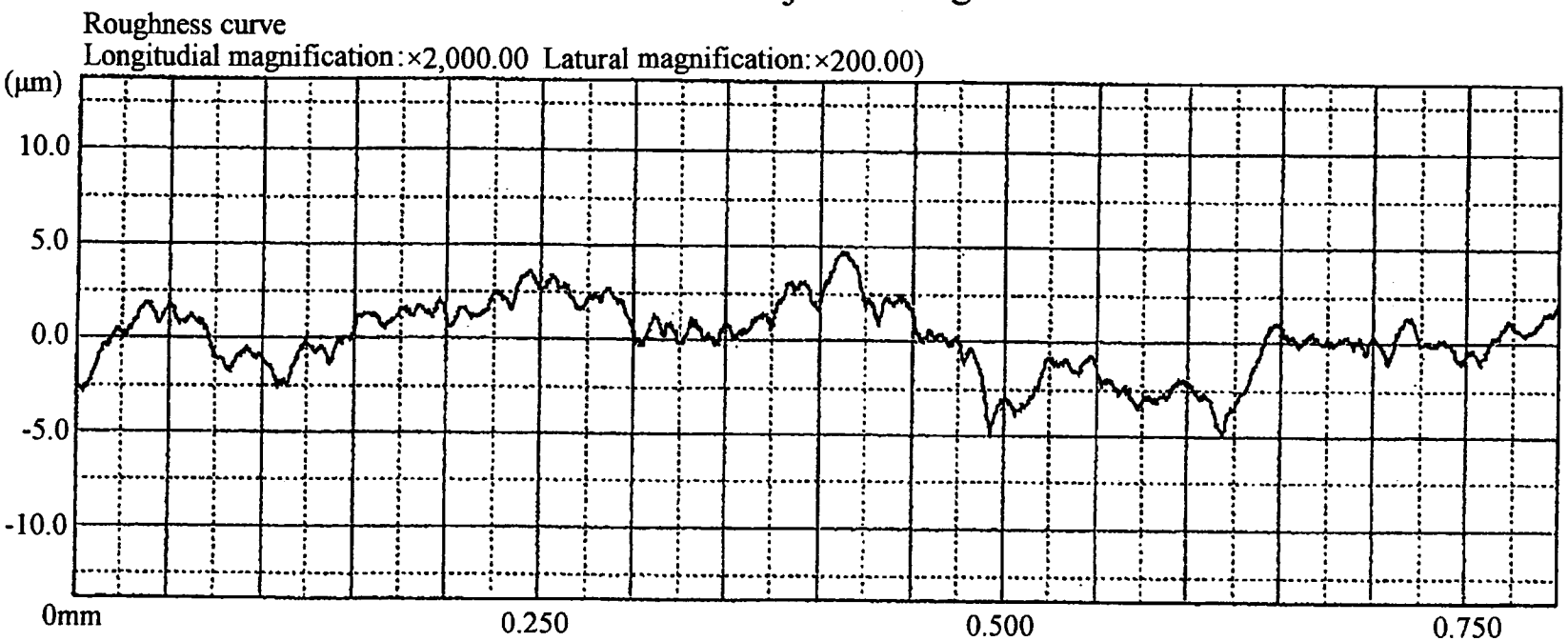
Figure 22D:
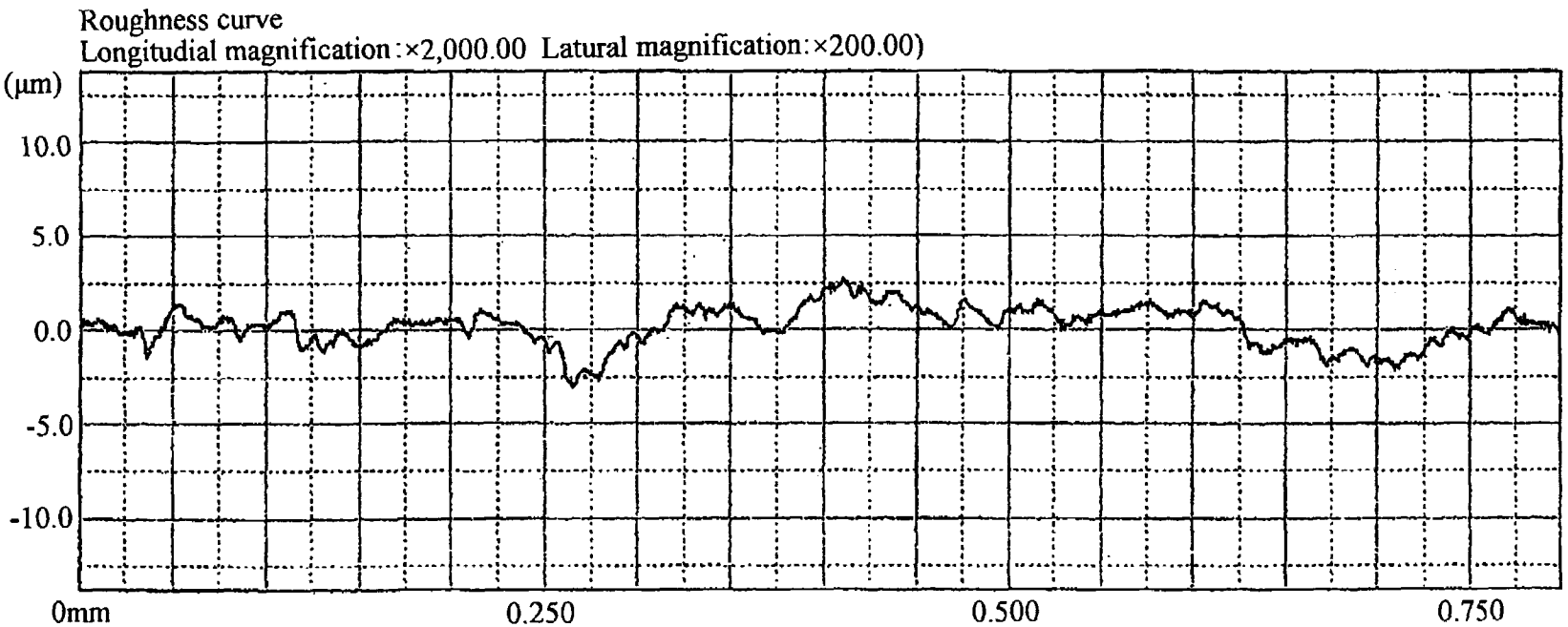

FIG. 19 and FIG. 20 show the surface roughness Ra and the reduction rate of the surface roughness Ra at a distance Xmm from the injection axis.

From FIG. 19 and FIG. 20, the surface roughness Ra on the injection axis is the smallest, namely, the reduction rate is the largest. The reduction rate of Ra at a position 15 mm from an injection center is kept 50% and it is found out that as the clearance between the regulation plate and the processing surface of the workpiece is narrower, flying energies of the abrasives in parallel with the processing surface of the workpiece can be used more effectively.

In the embodiment shown in FIG. 4, the injection gun 20 has a rectangular tip in which a slit-like injection opening 21 is formed. The longitudinal direction of the slit-like injection opening 21 is arranged in parallel with the processing surface of the workpiece, as well as the jet of the abrasives injected from the injection opening 21 is in parallel with the processing surface 10 of the workpiece And the injection gun 20 is placed on the processing surface 10 of the workpiece so that the jet of the abrasives to be injected from the injection opening 21 of the injection gun 20 is in parallel with the processing surface 10 of the workpiece.

Thus the regulation plate 41 is projected from a top edge or a position higher than the top edge of the injection opening 21 of the injection gun 20 disposed on the processing surface 10 of the workpiece, namely projected from a top edge of the injection gun 20 formed in a rectangular shape in the embodiment and the tip thereof is inclined toward the processing surface 10 of the workpiece, wherein the regulation plate 41 is disposed in a predetermined clearance from the processing surface 10 of the workpiece at the tip, and the regulation plate 41 prevents the jet of the abrasives from dispersing in the direction away from the processing surface 10 of the workpiece.

Figure 5:
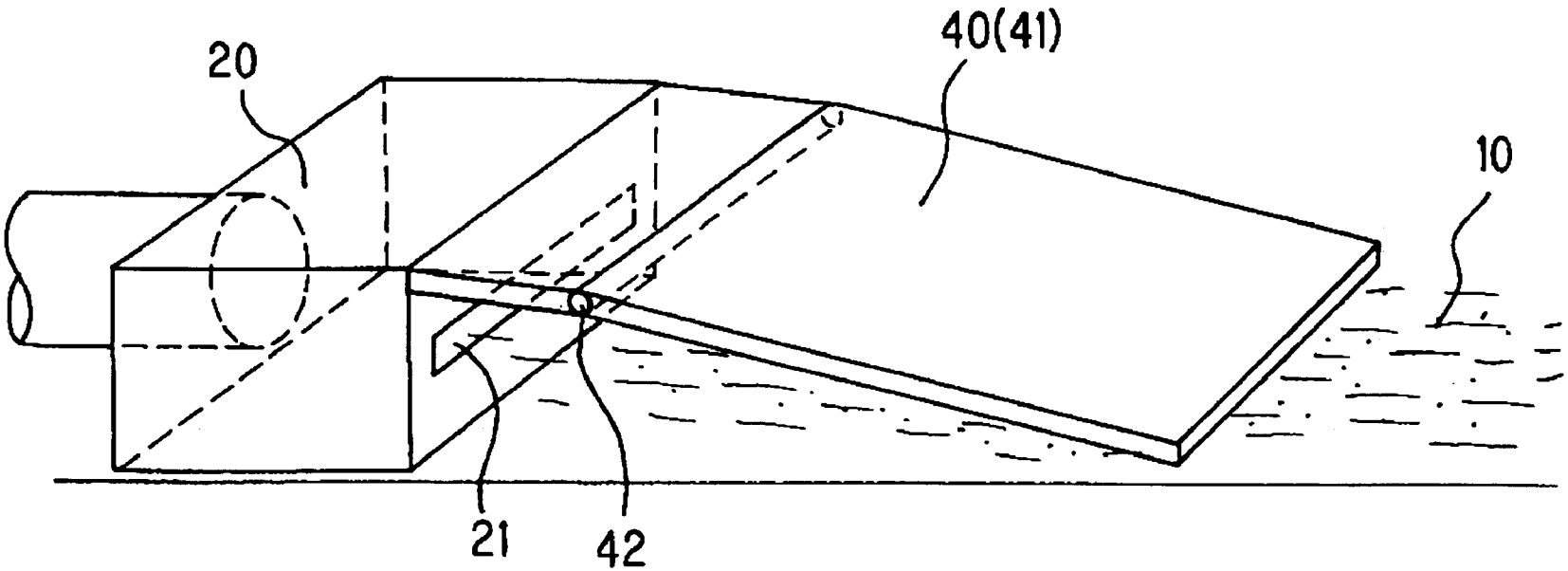
FIG. 5 is a perspective view showing another embodiment of a jet regulation means.

In the embodiment shown in FIG. 4, the regulation plate 41 as the jet regulation means 40 is integrated with the injection gun 20, but may be formed separately from the injection gun 20, and detachable from the injection gun 20, and for example as shown in FIG. 5, connected to the injection gun 20 by a hinge 42 or the like.

Although the injection gun 20 is described in the embodiments of FIG. 4 and FIG. 5 to be used combined with the jet regulation means 40 as the one having a tip shape of rectangle, in the embodiments shown in FIG. 6–FIG. 9, a generally known injection gun 20 is used in place of the above, as well as an oblique portion 411 corresponding to the inlet opening 31 to smoothly introduce the jet of the abrasives injected from the injection gun 20 is disposed in an oblique plate 41. abrasives injected from the injection gun 20 is disposed in an oblique plate 41 forming the jet regulation means 40. FIG. 10 corresponds to FIG. 3 and arranges the jet regulation means 40 in addition to FIG. 3.

The embodiment shown in FIG. 6 is constructed such that an end of the regulation plate 41 in the introduction side of the jet is inclined in the direction away from the processing surface 10 of the work piece with a predetermined clearance therefrom, thereby to smoothly introduce the jet of the abrasives injected from the injection gun 20 between the processing surface 10 of the work piece and the regulation plate 41.

An oblique angle $\alpha$ of the oblique portion 411 is, for example, 30°–0°, preferably 20°–0° to the portion in parallel with the surface of the work piece (body portion 412) in the regulation plate 41.

In the jet regulation means 40 of the embodiment shown in FIG. 6, the oblique portion 411 is thus disposed in the regulation plate 41, as well as legs 43 are provided to retain the body portion 412 of the regulation plate 41 to be spaced in a predetermined clearance from the processing surface 10 of the work piece.

In the embodiment shown in the drawing, the legs 43 are formed in four corners of the body portion 412 of the regulation plate 41, but the legs may be formed on the two sides in the longitudinal direction of the body portion 412, or two or more legs on each side may be disposed in the longitudinal direction of the body portion 412, namely the construction thereof is not limited to the embodiment.

The height of the leg 43 is set so as to maintain the body portion 412 of the regulation plate 41 with a predetermined clearance from the processing surface 10 of the work piece, for example, the clearance being in the range of from 20 mm–2 mm, preferably 10 mm–2 mm. protector 60 to cover the processing surface of the workpiece is disposed at the end of the side where the jet of the abrasives is introduced.

In the embodiment shown in FIG. 6, the protector 60 is formed so as to cover the processing surface 10 of the workpiece under the oblique portion 411 of the regulation plate 41, and formed in such manner that a plate body of flat rectangular shape is connected to the two legs disposed on the side of the abrasives jet introduction.

In addition, the protector 60, as shown in FIG. 6, is preferably formed in a tapered shape where the thickness is gradually reduced from the inlet side of the jet of the abrasives to the other end, and it is preferable that at the other end the steps formed with the processing surface 10 of the workpiece is gradually reduced.

In the jet regulation means 40 formed in such way, the jet of the abrasives injected from the injection gun 20 is introduced smoothly into the clearance between the processing surface 10 of the workpiece and the regulation plate 41 due to the oblique portion 411 disposed in the regulation plate 41.

And in case the injection gun 20 is arranged in the direction where the abrasives are injected at an certain angle to the processing surface 10 of the workpiece, a location position and a location angle of the injection gun 20, as well as the relative position between the injection gun 20 and the jet regulation means 40 are adjusted so that the protector 60 is positioned on a line extending in the injection direction of the abrasives, and thereby the abrasives having a vertical speed to the processing surface 10 of the workpiece clash into this protector 60 first, and then the travel direction thereof is changed to the horizontal direction by the clashing to the protector 60 to introduce the abrasives between the body portion 412 of the regulation plate 41 and the processing surface 10 of the workpiece. Accordingly, the vertical speed of the abrasives injected does not act directly on the workpiece, thereby the processing surface is prevented from being the satin finished surface securely.

In the embodiment explained with reference to FIG. 6, the injection gun 20 and the jet regulation means 40 are separately formed, but in an embodiment shown in FIG. 7, the injection gun 20 is integrated with the jet regulation means 40.

In the embodiment of this figure, a tip of the injection gun 20 is integrated with the oblique portion 411 of the regulation plate 41 in the jet regulation means 40, and the tip portion of the injection gun 20 is fixed to a lower surface of the oblique portion 411.

According to the embodiment shown in this figure, the legs 43 and the protector 60 are not disposed in the jet regulation means, but the legs and the protector may be disposed, the constitution being not limited to the embodiment shown in figure.

Figure 8:
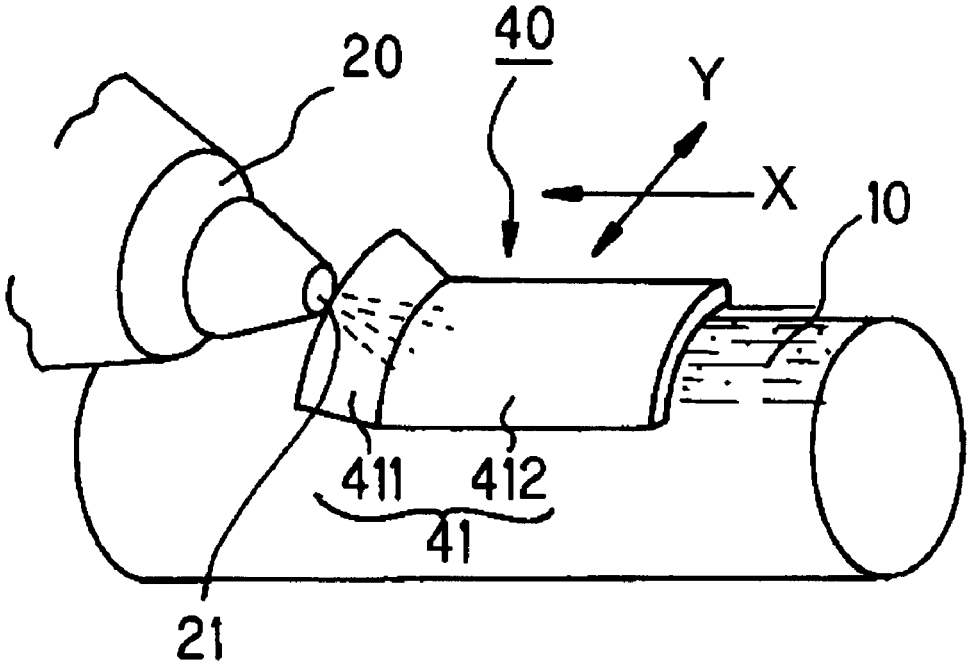
FIG. 8 is a perspective view showing a different embodiment of a jet regulation means.
Figure 9:
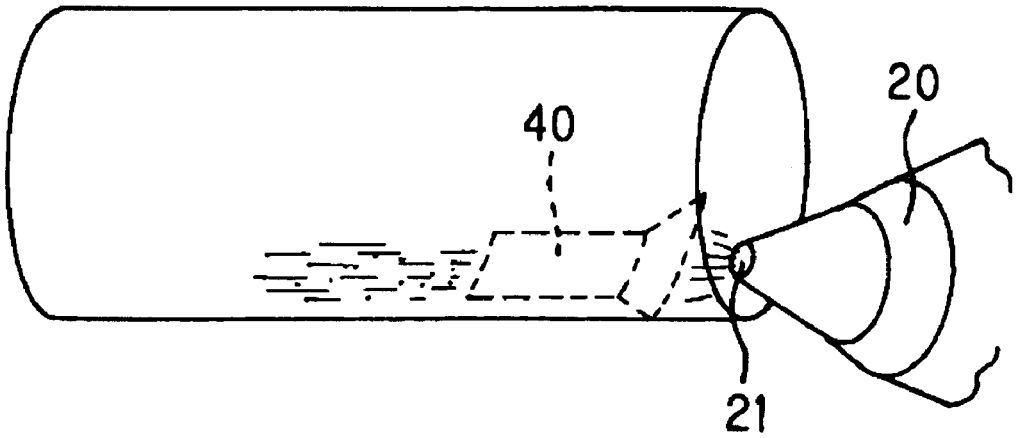
FIG. 9 is a perspective view showing a different embodiment of a jet regulation means.
Figure 10:
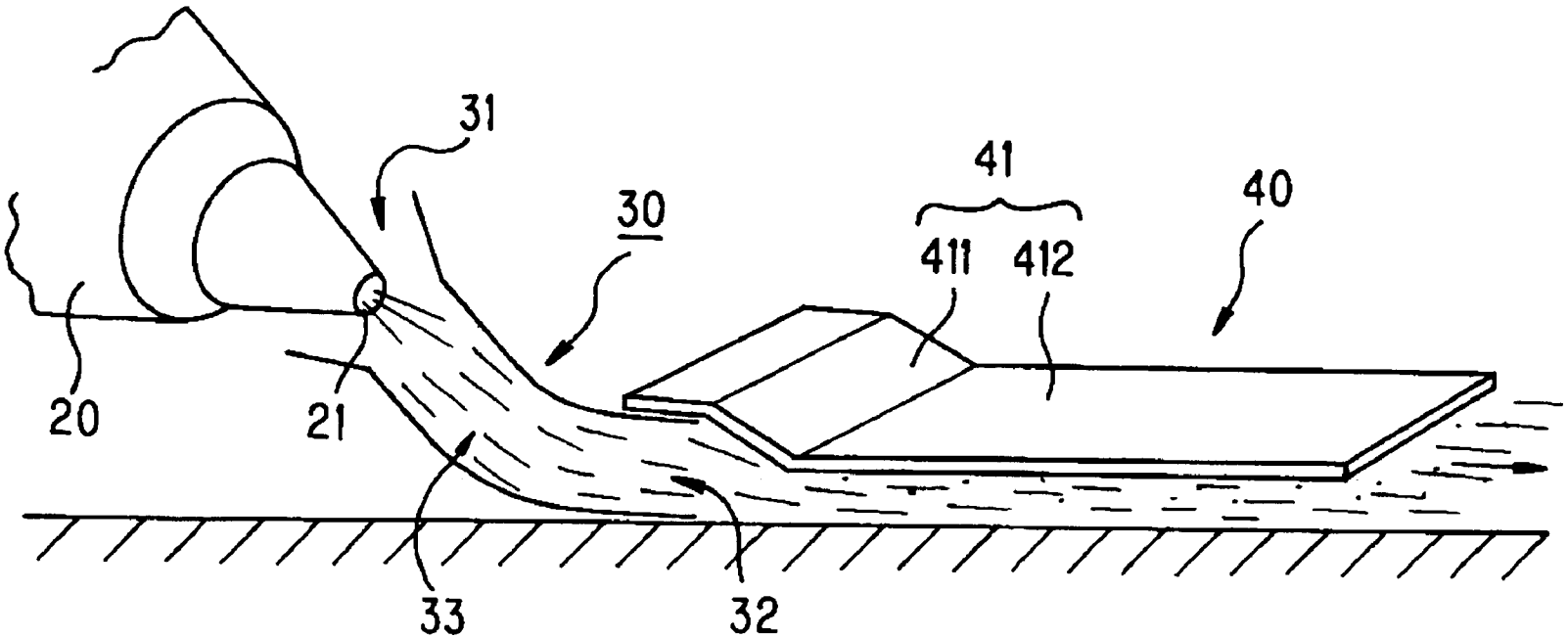
FIG. 10 is a perspective view showing a different embodiment of a jet regulation means.

The embodiments shown in FIG. 8 and FIG. 9 are for the case that workpieces are cylindrical and for jet regulation means 40 to be used when the processing surface 10 is an outer surface or an inner surface of the workpiece.

Thus in case the processing surface 10 of the workpiece is curved, the shape of the jet regulation means 40 may be formed in a curved shape conforming to the shape of the processing surface 10 and the jet regulation means 40 may be arranged in parallel with the processing surface 10 of the workpiece.

In the embodiments shown in FIG. 6–FIG. 9, all the explained embodiments are such types that the jet of the abrasives injected from the injection gun 20 is introduced directly to the jet regulation means 40. The introduction of the jet of the abrasives to the jet regulation means 40 may be constituted in such manner that the jet of the abrasives injected from the injection gun 20, for example, is introduced to the jet guide means 30 once as shown in FIG. 10, and then the abrasives are deflected to a direction of the predetermined incident angle and guided by the jet guide means 30 to the jet regulation means 40.

And in the above case, the guiding outlet 32 of the jet guide means 30 may be fixed to the lower surface of the oblique portion 411 of the jet regulation means 40, to be formed integral with the jet regulation means 40.

In the embodiments of the jet regulation means 40 as explained above, it is explained that the clearance between the regulation plate 41 and the processing surface 10 of the workpiece is fixed in a predetermined value, but the clearance between the processing surface 10 of the workpiece and the regulation plate 41 may be arranged to be variable.

Figure 11A:
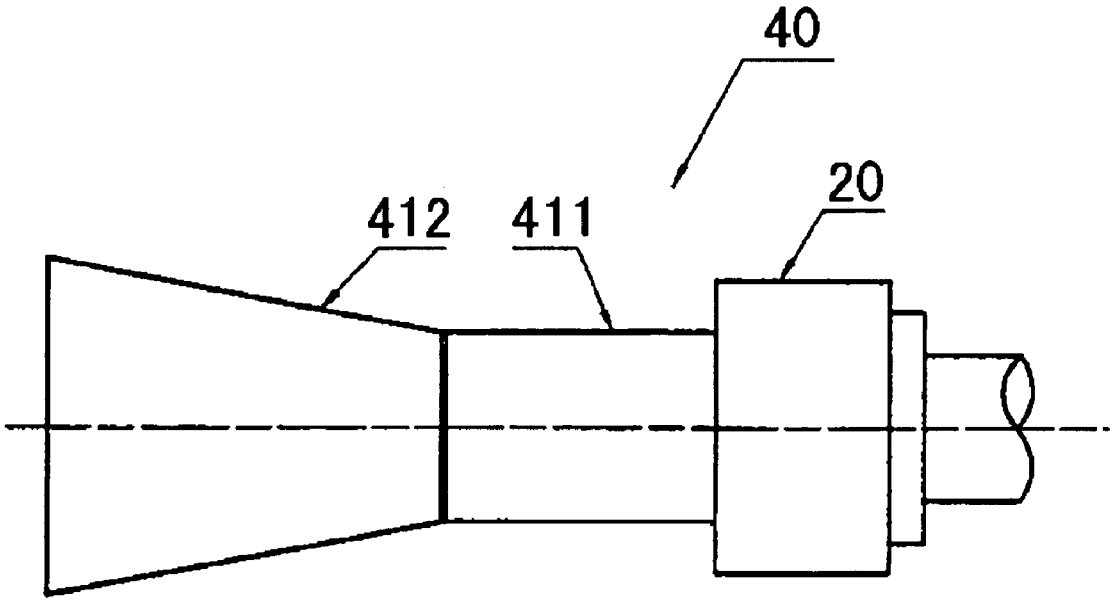
FIG. 11A is a plan view showing a different embodiment of a jet regulation means.
Figure 11B:
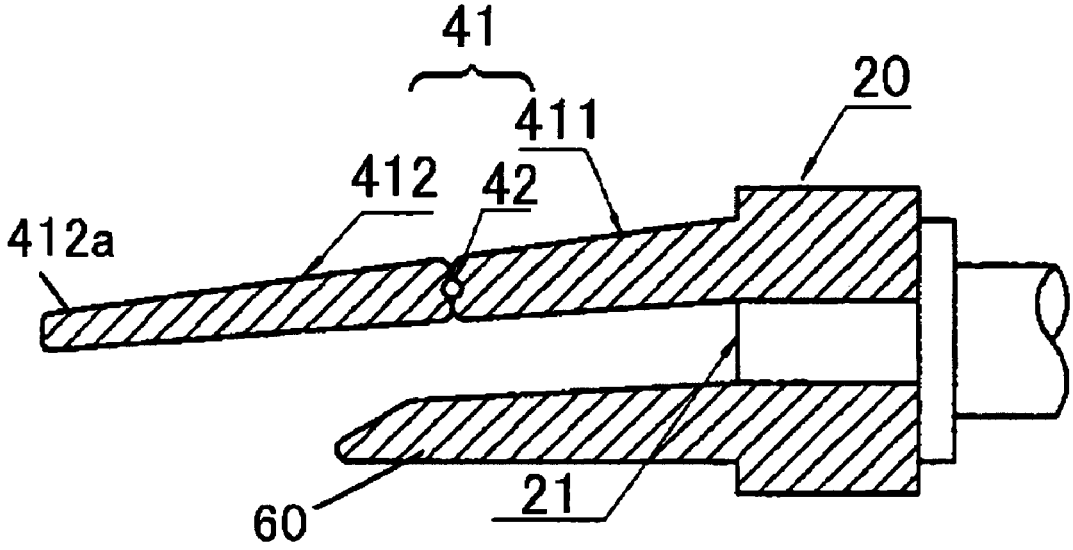
FIG. 11B is a cross sectional view showing a different embodiment of a jet regulation means.

One embodiment of the jet regulation means 40 in which the clearance between the processing surface 10 of the workpiece and the regulation plate 41 is variable is shown in FIG. 11(A) and FIG. 11(B).

As shown in FIG. 11(B), the jet regulation means 40 of the embodiment is integral with the injection gun 20 which has a tip formed in a rectangular shape, and the regulation plate 41 projected from the top edge of the slit-like injection opening 21 formed in a rectangular tip of the injection gun 20 and the protector 60 projected from the lower end of the injection opening 21 to cover the processing surface 10 of the workpiece are provided.

The regulation plate 41 is formed with the oblique portion 411 which is slanted so that the clearance between the regulation plate 41 and the processing surface of the workpiece is gradually reduced in a predetermined length in the projecting direction at one end of the regulation plate 41 connected to the injection gun 20 and the body portion 412 is connected to the tip of the oblique portion 411 by a hinge 42, thereby to become in parallel with the processing surface of the workpiece at the injection timing of the abrasives.

The protector 60 is arranged under the oblique portion 411 of the regulation plate 41 and the processing surface 10 of the workpiece in the vicinity of the injection opening 21 is covered and protected by the protector 60.

The body portion 412 of the regulation plate 41 is constructed to be rotatable through the hinge 42 in the direction of the arrow in FIG. 11(B). When the jet of the abrasives is not injected from the injection opening 21 of the injection gun 20, an end (hereinafter referred to as free end 412*a*) of the body portion 412 which is not connected by the hinge 42 is inclined in the direction to narrow the clearance with the processing surface 10 of the workpiece due to its weight.

The body portion 412 is constituted to have such weight as to be oscillatable due to the pressure, the speed, or the like of the jet, and when the jet of the abrasives are injected from the injection opening 21, the free end 412*a* moves away from the processing surface 10.

When the jet of the abrasives is injected from the injection opening 21 of the injection gun 20 to which the jet regulation means 40 is mounted as described above, the jet injected from the injection gun 20 is introduced inside the clearance between the protector 60 and the oblique portion 411, and then introduced between the processing surface 10 of the workpiece and the body portion 412 of the regulation plate 41.

Since the processing surface 10 of the workpiece in the vicinity of the injection opening 21 of the injection gun 20 is covered by the protector 60, even in case the abrasives injected from the injection opening 21 are injected at an angle to the processing surface 10 of the workpiece in the vicinity of the injection opening 21, the vertical speed which the abrasives have does not act directly on the processing surface 10 of the workpiece, preventing the processing surface 10 of the workpiece from becoming the satin finished surface.

The body portion 412 of the regulation plate 41 is rotated around the hinge 42 by the jet of the abrasives injected from the injection gun 20, to push up the free end 412*a*, so that a predetermined clearance is formed between the free end 412*a* and the processing surface 10 of the workpiece, as well as the jet of the abrasives is regulated by the body portion 412 of the regulation plate 41 not to disperse in the direction to be separated from the processing surface 10 of the workpiece, and a predetermined amount of the abrasives of high density pass along the shape of the processing surface between the processing surface 10 of the workpiece and the body portion 412 of the regulation plate 41.

Accordingly the processing surface 10 of the workpiece is ground to be glossy surface and the like without becoming the satin finished surface due to the abrasives traveling along the processing surface 10 of the workpiece.

Figure 12:
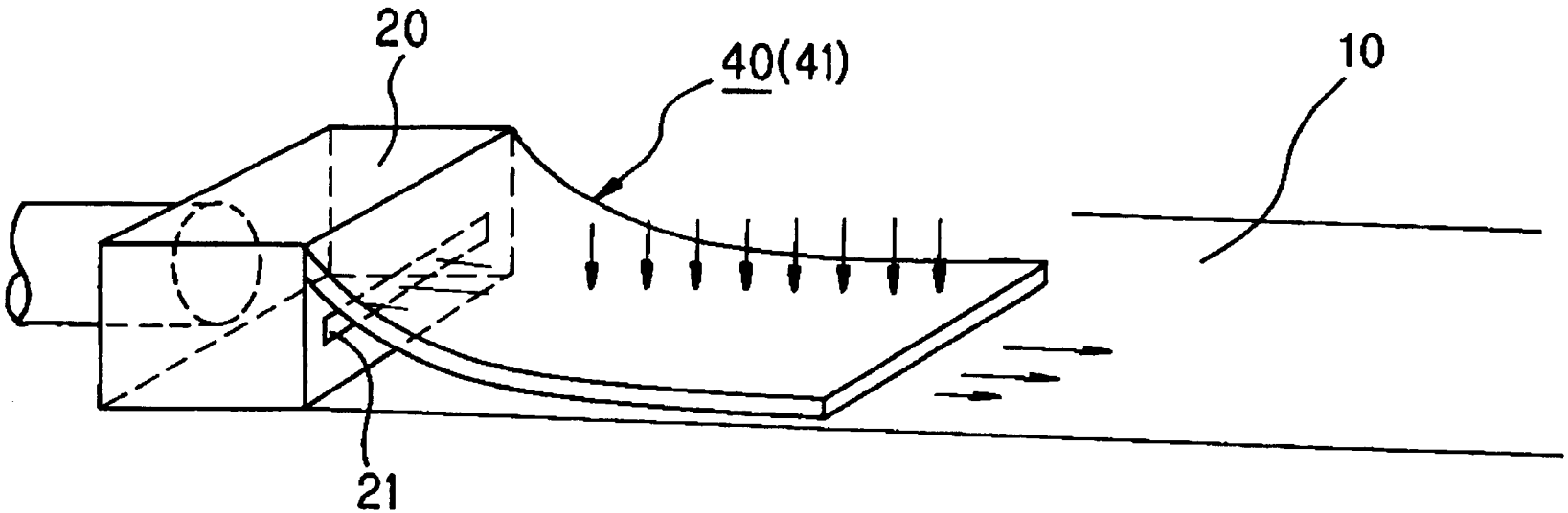
FIG. 12 is a perspective view showing a different embodiment of a jet regulation means.

FIG. 12 further shows another embodiment of the jet regulation means 40 where the clearance of the regulation plate 41 with the processing surface 10 of the workpiece is variable. As for provision of the injection gun 20 of the abrasives and the regulation plate 41, the same construction of the jet regulation means 40 explained with reference to FIG. 11 is found.

While in the jet regulation means 40 of the embodiment shown in FIG. 11, the regulation device 40 is rotatable by the hinge 42, thereby the clearance with processing surface 10 of the workpiece is variable, in the embodiment shown in FIG. 12 the regulation plate 41 is formed of a flexible material such as a resin material, a metallic material, and the clearance with the processing surface 10 of the workpiece is varied due to deformation of the regulation plate 41.

In addition, the regulation plate 41 is mounted to the injection gun 20 to be directed downward in the injection direction as shown in FIG. 12 and is constructed such that when the injection gun 20 is placed on the processing surface 10, a predetermined clearance is formed between them or no clearance is formed to have a direct contact thereof.

Further, in the embodiment shown in FIG. 12 the protector 60 which is disposed in the embodiment in FIG. 11 is not disposed. However, also in the embodiment shown in FIG. 12 the protector 60 may be disposed in the same way with the jet regulation means 40 in the embodiment shown in FIG. 11.

When the jet regulation means 40 as constructed above is placed on the processing surface 10 of the workpiece and the injection of the abrasives starts from the injection opening 21 of the injection gun 20, the jet of the abrasives injected from the injection opening 21 of the injection gun 20 is introduced between the processing surface 10 of the workpiece and the regulation plate 41.

The jet of the abrasives introduced between the processing surface 10 of the workpiece and the regulation plate 41 deforms the regulation plate 41 formed of flexible material, to generate an optimal clearance between the processing surface 10 of the workpiece and the regulation plate 41 based upon the balance between injection energies of the jet such as an injection pressure and an injection speed, and material flexibility of the regulation plate 41, or the like.

Thus a proper clearance is formed based upon injection energies of the jet between the processing surface 10 of the workpiece and the regulation plate 41, to prevent the jet from dispersing in the direction to be away from the processing surface 10 of the workpiece. Accordingly the jet is introduced between the processing surface 10 of the workpiece and the regulation plate 41 to grind the processing surface 10 of the workpiece by the abrasives traveling in parallel with the processing surface without forming the satin finished surface thereon.

Figure 13:
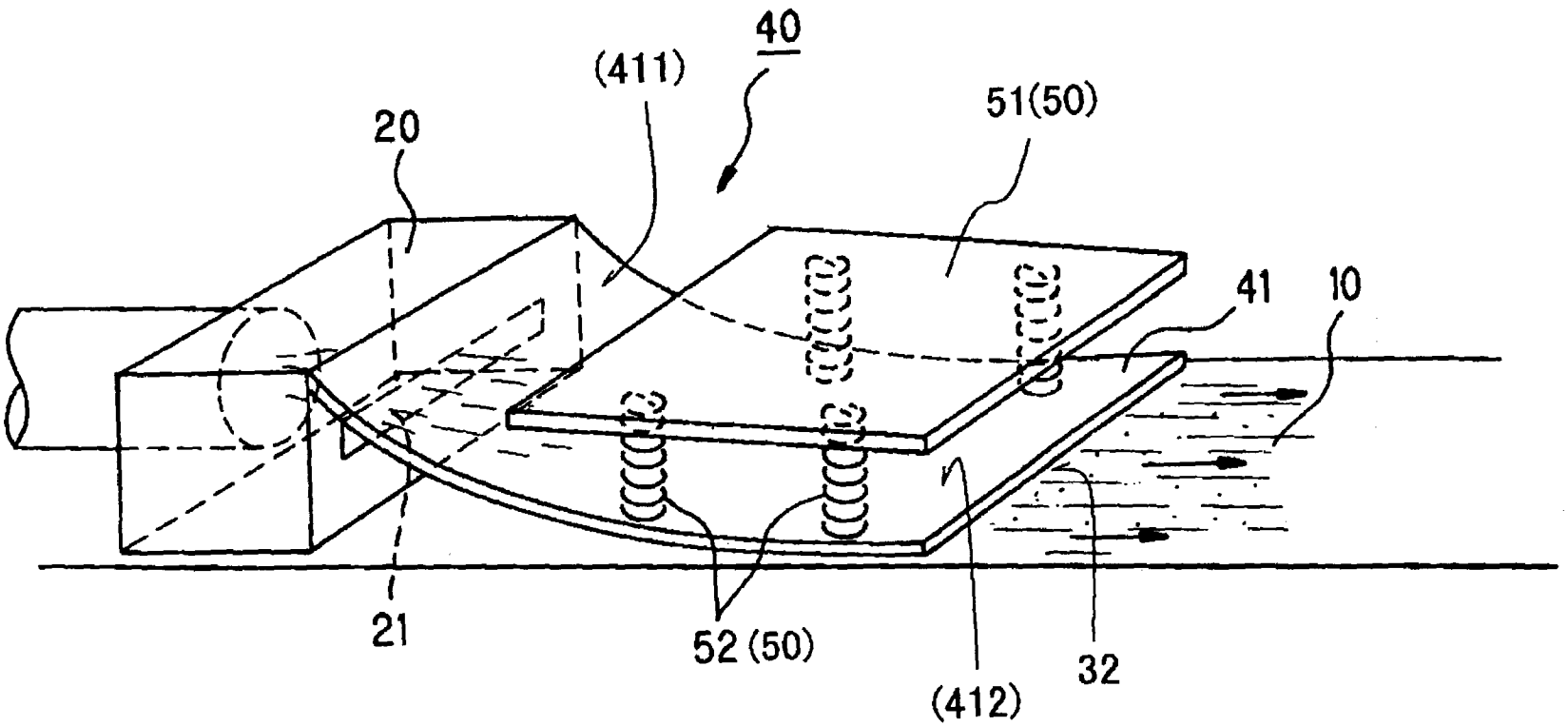
FIG. 13 is a perspective view showing a different embodiment of a jet regulation means.

However, the structure of the jet regulation means 40 to adjust the clearance between the regulation plate 41 and the processing surface 10 of the workpiece by the pressure of the jet or the like to an optimal clearance is not limited to the embodiment where the regulation plate 41 is adjustable by the resiliency of flexible material as described above. As shown in FIG. 13, an urging means 50 to urge the regulation plate 41 downward may be disposed to urge the regulation plate 41 toward the processing surface 10 of the workpiece by this urging means 50.

In order to thus urge the regulation plate 41, in the embodiment a pressure plate 51 is disposed over the regulation plate 41 which projects in parallel with the processing surface 10 of the workpiece from the top end of the injection gun 20 and coil springs 52 are disposed between the pressure plate 51 and the regulation plate 41 to urge the regulation plate 41 toward the processing surface 10 of the workpiece.

The coil springs 52 are constructed to generate the adequate force to secure a proper clearance based upon the jet energies between the processing surface 10 of the workpiece and the regulation plate 41 urged from the jet of the abrasives, and accordingly to generate a proper clearance based upon an injection pressure, an injection speed, or the like of the jet between the processing surface 10 of the workpiece and the regulation plate 41 when the jet of the abrasives are injected from the injection gun 20.

The regulation plate 41 is formed of flexible material in the same as in the embodiment shown in FIG. 12 and the clearance with the processing surface 10 of the workpiece may be varied by the deformation of the regulation plate 41 and may be adjusted by connecting the injection gun 20 with the regulation plate 41 by the hinge 42 or by connecting the oblique portion 411 with the body portion 412 by the hinge 42 or the like.

And in the embodiment, provision of the pressure plate 51 and the coil springs 52 causes to urge the regulation plate 41. However, in case the regulation plate 41 is connected to the injection gun 20 by the hinge 42, a wire spring or a leaf spring may be disposed to oscillate the regulation plate 41 in the direction of the processing surface 10 of the workpiece around the hinge 42, and an urging means is not limited to the embodiment shown in the figure as long as the regulation plate 41 is urged toward the processing surface 10 of the workpiece.

When the jet regulation means 40 as constructed above is placed on the processing surface 10 of the workpiece and the abrasives are injected from the injection gun 20, the jet of the abrasives is introduced between the workpiece and the regulation plate 41 to push upward the regulation plate 41 in accordance with energies of the introduced jet such as pressure thereof to form an optimal clearance between the processing surface 10 of the workpiece and the regulation plate 41 based upon the jet energies or the like.

And the jet introduced in the clearance formed between the processing surface 10 of the workpiece and the regulation plate 41 forms the flow substantially in parallel with the processing surface 10 of the workpiece and as result, the processing surface 10 of the workpiece can be ground with no satin finished surface formed.

Grinding Method

Figure 7:
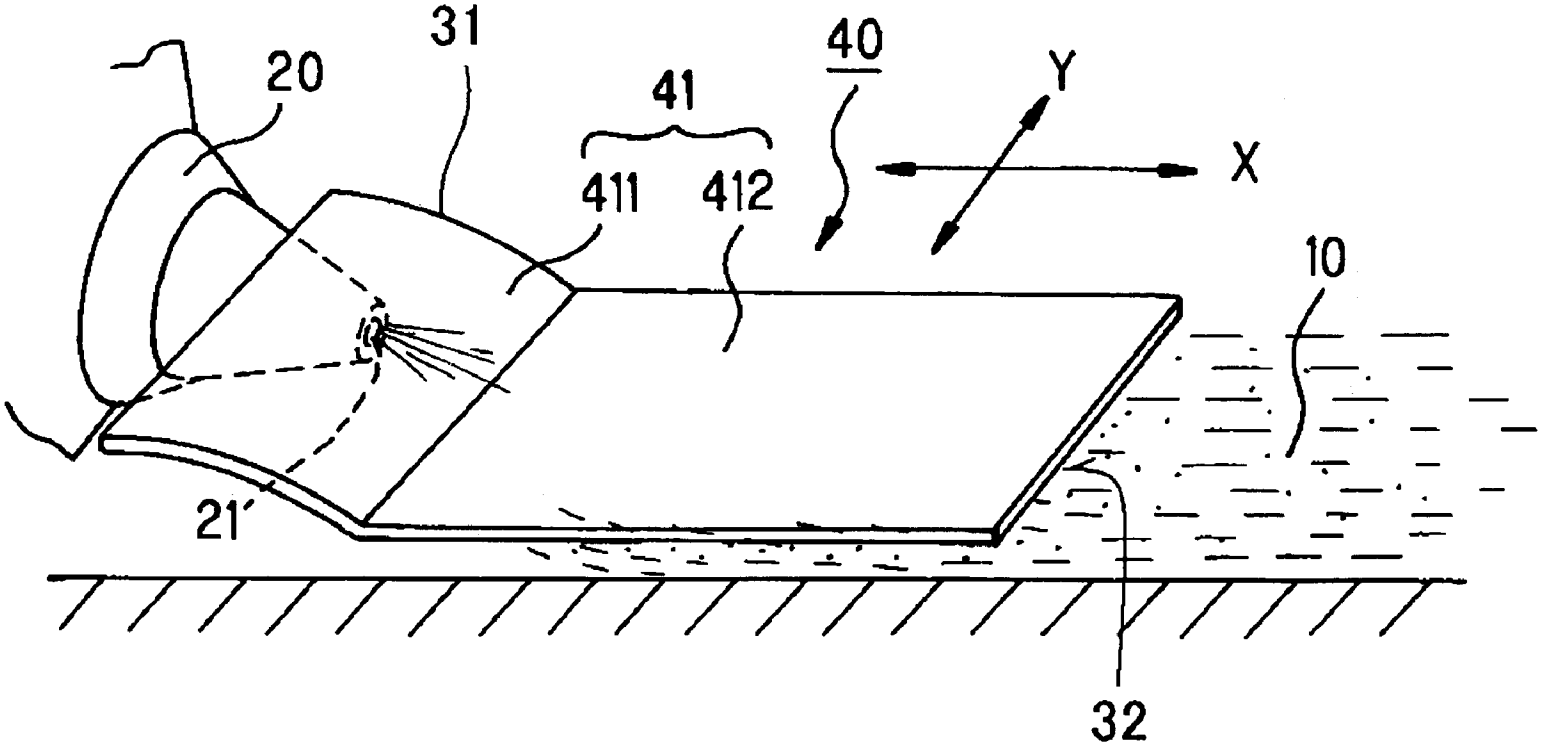
FIG. 7 is a perspective view showing a different embodiment of a jet regulation means.

In the grinding method as constituted above, in the case of grinding without use of the jet guide means 30 or the jet regulation means 40, the grinding to the workpiece is performed by relatively traveling the injection gun 20 in the X-Y directions as shown in FIG. 7 and on the other hand, in the case of grinding with use of the jet guide means 30 or the jet regulation means 40, by relatively traveling the injection gun 20, as well as the jet guide means 30 and/or the jet regulation means 40 in the X-Y directions as shown in FIG. 7.

In the case of grinding the processing surface 10 of the workpiece using the jet regulation means 40, width of the jet can be varied by varying the width of the jet regulation means 40, namely the width of the regulation plate 41, so that the grinding can be applied to various workpieces having different areas of the processing surface 10.

And in the embodiments explained with reference to FIG. 6–FIG. 13, the grinding is performed by using one injection gun 20 and one jet regulation means 40, but processing a workpiece having an wide area may be made in use of a plurality of injection guns 20 and a plurality of regulation devices 40 simultaneously, and by use of a plurality of injection gun 20 disposed to one jet regulation means 40, and in contrast, by use of a plurality of regulation means 40 disposed to one injection gun 20, and by their combinations.

The selection of shapes and width of the jet regulation means 40 mounted to the injection gun 20 and masking the unnecessary portion to avoid the abrasives contact can easily cover the variety shapes of processing surface. Surface shapes of the workpiece may not to be only a flat processing surface, but also a processing surface having a groove, a stepped groove, inner/outer surfaces of a cylinder shown in FIG. 8 and FIG. 9, and further a hole, groove, a stepped cylinder or the like, not limited to the flat shapes.

The grinding to the workpiece having a complicated shape (concave/convex, groove, stepped groove processing) or an inner surface processing (a hole, a groove) can be performed by adjusting a width of the regulation plate and an injection speed of the abrasives.

Further, the grinding can be more effectively performed by use of robots.

Moreover, the grinding of workpieces may be independently performed for grind processing only, but for example, a blast processing and a grind processing may be performed together where as the first step the satin finished surface is formed on the processing surface 10 of the workpiece by a usual blast processing method and as the successive second step the grind processing is performed by the above-described method, thereby the surface roughness generated by the blast processing is made smoother, performing gloss finish or mirror finish.

And in the case of grinding workpieces containing stain, weld flash, paint, resin or the like on the processing surface, these defectives are removed by a usual blast processing method to produce a satin finished surface as the first step and as the successive second step, the surface roughness is made smoother by the above described grind processing method, performing gloss finish or mirror finish.

EXAMPLES

Next, embodiments where grind processing is performed by the method of the present invention will be explained.

Example 1

Grinding of Silicon Wafer

TABLE 5

| Processing Conditions | |
|---|---|
| WORKPIECE | 5 INCHES SILICON WAFER (DICING PRODUCT) |
| BLAST PROCESSING DEVICE | SGF-4 (made in Fuji Manufacturing Co., Ltd.) |
| INJECTION GUN | F2-2A (made in Fuji Manufacturing Co., Ltd.) |
| ABRASIVE | FUJIRUNDUM WA (WHITE ALUNDUM), #1500 (made in Fuji Manufacturing. Co., Ltd.) |
| INJECTION PRESSURE | 0.4 MPa |
| PROCESS TIME | 120 seconds |
| INCIDENT ANGLE | 10° |
| DISTANCEC BETWEEN REGULATION PLATE AND WORKPIECE | 2 mm |
| REGULATION PLATE | URETHANE RUBBER SHEET TYPLANE UL (Tigers Polymer Corporation) 2 mm THICK |
| SHAPE/SIZE | TRAPEZOID, 70 mm TOP SIDE WIDTH, 130 mm BOTTOM WIDTH, 150 mm LONG |
| PROTECTION SHEET | USE OF ABOVE URETHANE RUBBER SHEET |
| SHAPE, SIZE | RECTANGLE, 50 mm WIDE, 120 mm LONG, 2 mm THICK |

The protector was located so as to contact the processing surface of the workpiece. The regulation plate was in parallel with the processing surface of the workpiece and was balanced with the jet by flexibility of the regulation plate, to stably inject the abrasives from the bottom of the trapezoidal regulation plate. The regulation plate was the same as the open urged urethane regulation plate. The longitudinal direction of the regulation plate and the protector were aligned roughly in accordance with the direction of injection from the injection gun.

The top side of the trapezoidal regulation plate was fixed by a vinyl tape on the chip holder of the injection gun F2-2A (Fuji Manufacturing Co., Ltd.).

The shorter side of the protector was fixed to the gun chip holder in the same manner.

Before start of grinding, a preliminary treatment was performed to form the satin finished surface by injecting the abrasives on the silicon wafer surface with injection pressure of 0.4 MPa, injection angle of 90°.

In this state, the injection gun was moved in the X-Y axis directions of the processing surface of the workpiece, to perform grinding.

As the result of the grinding under the above processing conditions, it was confirmed that the regulation plate mounted to the injection gun stably retained the clearance of about 2 mm to the processing surface of the workpiece and the jet of the abrasives passing through the clearance between the processing surface of the workpiece and the regulation plate were properly regulated.

And it was confirmed that a uniform jet was formed along the processing surface ahead of the tip of the regulation plate positioned in front of the injection direction of the abrasives.

The processed surface of the workpiece obtained after the grind processing became a glossy surface without the satin finished surface formed. The result is as follows.

The measurement result of the surface roughness of silicon wafer is as follows.

TABLE 6

Figure 23:
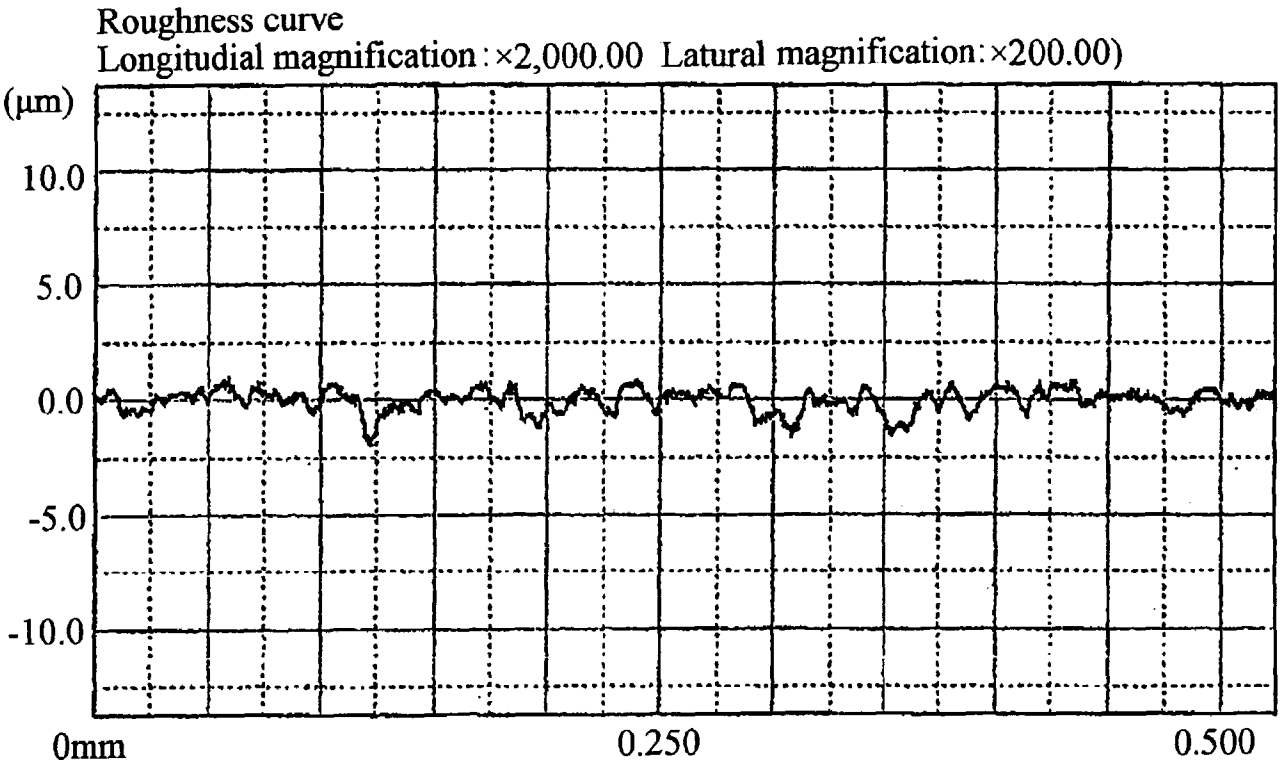
FIG. 23 is a graph showing a roughness curve after dicing in a silicon wafer processing.
Figure 24:
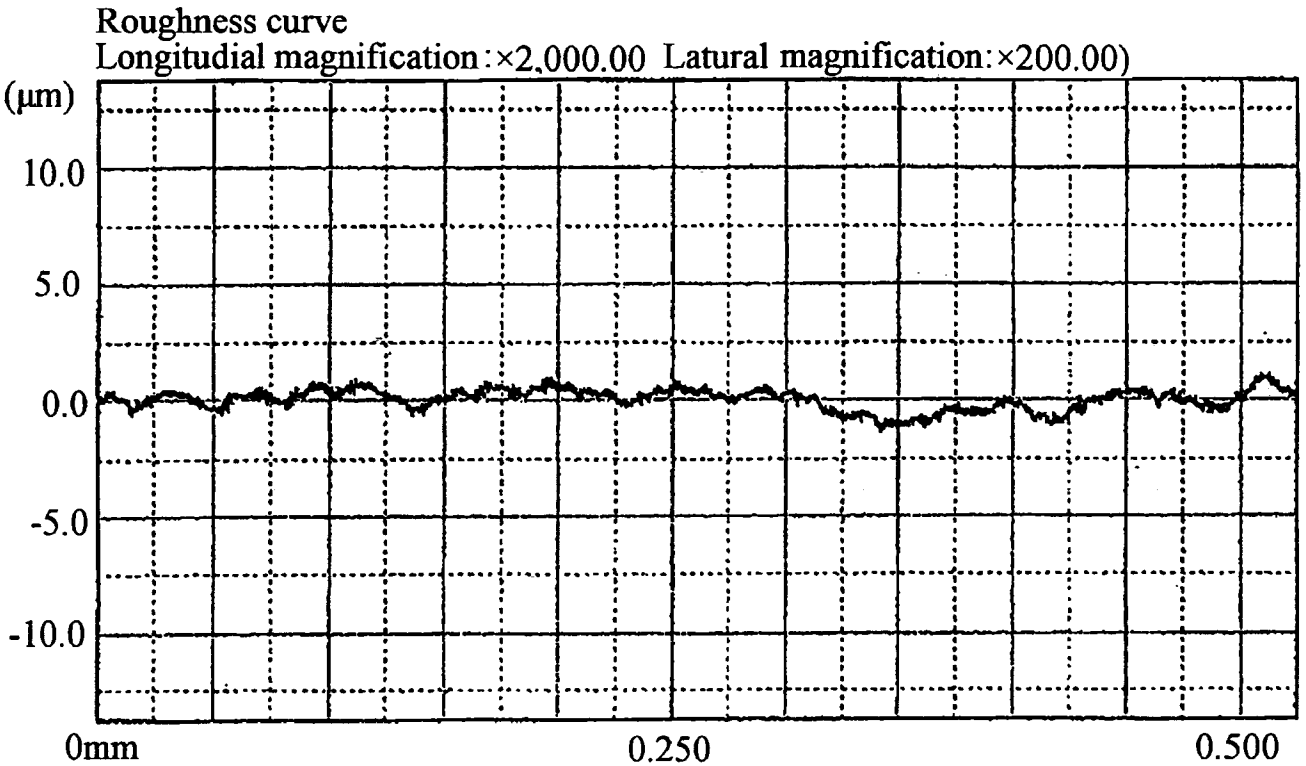
FIG. 24 is a graph showing a roughness curve of a preliminary treatment (injection angle of 90°) in the silicon wafer processing.
Figure 25:
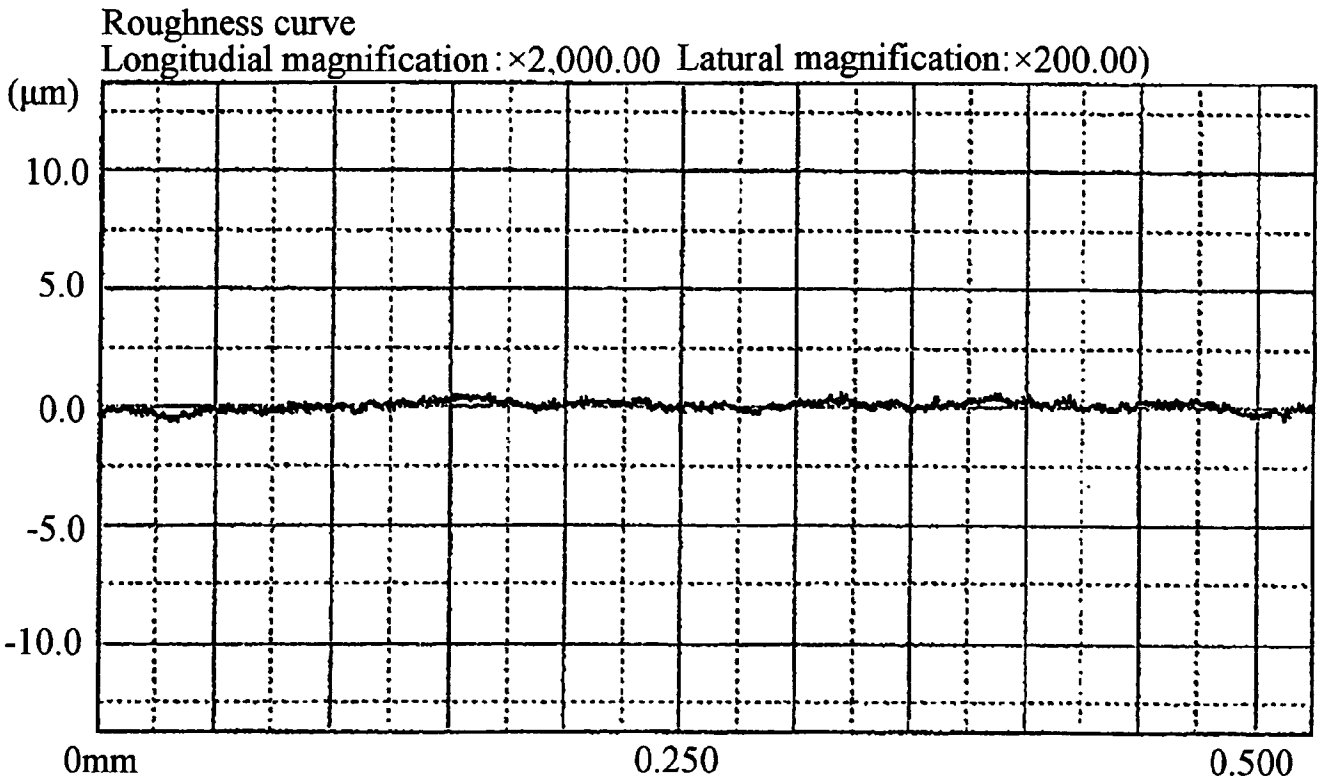
FIG. 25 is a graph showing a roughness curve after processing by an embodiment in the silicon wafer processing; and, FIG. 26 is a picture showing a processed surface of the embodiment in FIG. 25 and a preliminary treatment surface in FIG. 24.

| Surface Roughness Ra | | |
|---|---|---|
| | SURFACE ROUGHNESS | |
| OBJECT | Ra (μm) | GLOSS (%) |
| SILICON WAFER: AFTER DICING (FIG. 23) | 0.399 | 9 |
| AFTER PRELIMINARY TREATMENT (INJECTION ANGLE 90°; FIG. 24) | 0.322 | 27 |
| AFTER GRIND PROCESSING (PRESENT EMBODIMENT; FIG. 25) (PARALLEL ABRASIVE JET) | 0.174 | 150 |

The measurement device and the measurement condition are the same as the above described.

The surface roughness Ra in the example (after grinding process) was reduced to the surface roughness 54% of the preliminary treatment (injection angle of 90°), to have proved the effect of the processing method of the present invention. This effect was also confirmed by the surface roughness curve.

It was confirmed that in the example by the preliminary treatment, very small uneven portions were left (FIG. 24) and in the embodiment by the processing method of the present invention (FIG. 25), the projections among the uneven portions were ground to become flat. This is because the abrasives collide with the projections among the uneven portions by substantially horizontal-direction jet thereof to become flat. A cutting amount by one abrasive having a tiny mass is extremely small and its cutting amount is estimated to be a few nm. However, high-speed grinding is possible by a large number of abrasive particles.

Surface Reflection

Gloss measurement was performed by using a gloss gauge PG-1M (Nippon Denshoku Industries Co., Ltd.). An angle of incident light and reflective light were 60°. The improvement of glossiness is more than five times compared with the state after the preliminary treatment.

The embodiment reflects the backside pattern and provides the mirror finish. This is because the surface unevenness of the workpiece were ground by the abrasive particles flowing in the horizontal direction, to form the flat portions. This situation was confirmed by the surface state and the roughness curve by an optical microscope.

Figure 26:
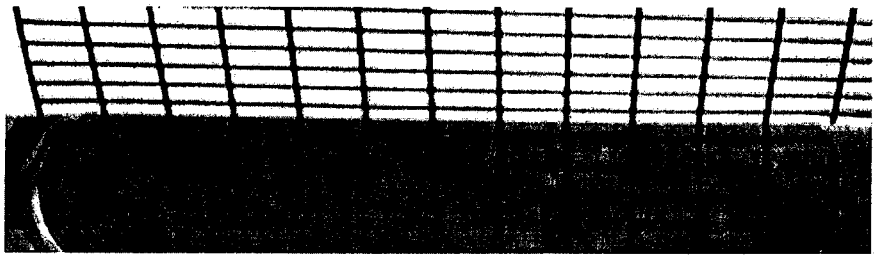

On the other hand, in the comparative example of an injection of 90°, the processing surface becomes a satin finished surface and a reflective image of the backside pattern is not obtained (the right side half in FIG. 26 is the mirror surface according to the embodiment, the left side half is the preliminary treatment surface-90°).

Conventionally in the case of grinding a silicon wafer, the grinding using a lapping machine with pressure to the processing surface is performed and in order to provide a glossy surface or a mirror surface, the grinding using a extremely fine particle of 0.01 μm–0.1 μm is required.

However, according to the grinding method of the present invention, it is not necessary always to use such fine abrasives. The reason is estimated that the abrasives flying substantially in parallel with the processing surface 10 of the workpiece collide with sides of the projections among the uneven portions, thereby to cut and remove them finely. And due to such grinding mechanism of the present invention, occurrence of a process deterioration layer which has occurred in a normal grinding such as a grinding by a lapping machine to grind the processing surface at a pressurized state as described above is prevented or restricted and accordingly, heat treatment after the grind processing or jobs to remove the deteriorated layer by acid or alkali is not required anymore.

Embodiment 2:

Grinding of Optical Glass

TABLE 7

| | Processing Condition |
|---|---|
| WORKPIECE | OPTICAL GLASS (BK7) |
| BLAST PROCESSING DEVICE | SGF-4 (made in Fuji Manufacturing Co., Ltd.) |
| INJECTION GUN | F2-2A (made in Fuji Manufacturing Co., Ltd.) |
| ABRASIVE | FUJIRUNDUM WA (WHITE ALUNDUM) #220 |
| INJECTION PRESSURE | 0.4 MPa |

Processing Method

The optical glass (BK7) having the thickness of 0.4 mm was ground by using the above blast processing device and the abrasives.

Before start of the grinding, a preliminary treatment was performed on the surface of the optical glass as the workpiece by injecting the abrasives at an injection pressure of 0.4 MPa and an injection angle of 90° to provide a satin finished surface.

Next, a grind processing was performed by injecting the above-described abrasives at an injection pressure of 0.4 MPa using the injection gun equipped with the jet regulation means shown in FIG. 4.

The regulation plate disposed in the jet regulation means used was of SUS304 (material property) which was 120 mm wide× 120 mm long× 5 mm thick and was located in a 10 mm clearance to the surface of the optical glass.

In the Comparative Example 1, only the preliminary treatment (blasting) of the above described conditions was performed and the optical glass without the grind processing applied thereto was used and the other conditions except that the grind processing was not carried out were the same as the above embodiment.

In the Comparative Example 2, only the preliminary treatment (blasting) of the above described conditions was performed and thereafter, etching treatment was performed for 8 minutes by the mixing of hydrofluoric acid of 60% and sulfuric acid of 40%.

The confirmation result of whether or not micro-cracks occurred in the Examples, Comparative Example 1 and Comparative Example 2 is shown in Table 8 below.

Judgment of micro-cracks occurrence shown in the Table 8 was done in load percentage evaluation and SEM observation where the ratio of the breakage load of the processed sample against the breakage load of non-processed ingredient glass applying a load in the center of specimen supported by both ends fixed.

TABLE 8

| SAMPLE | LOAD CAUSING DAMAGE (%) | OCCURRENCE OF CRACK |
|---|---|---|
| EMBODIMENT 2 | 99 | NO |
| COMPARATIVE EXAMPLE 1 | 30 | YES |
| COMPARATIVE EXAMPLE 2 | 98 | NO |

As the results, the breakage load of the optical glass ground by the method of the present invention are substantially equal with the breakage load of the non-processing products and also the occurrence of micro-cracks is not confirmed by SEM observation.

In the case of processing hard, fragile material such as glass, quartz, ceramics as a workpiece, the micro-cracks occur on the surface caused by the grinding and the occurrence of the micro-cracks significantly deteriorates the strength of the workpiece. Therefore, in the case of grinding these workpieces by the conventional method, in order to remove the micro-cracks generated, the surface of the workpiece is solved out by hydrofluoric acid by a minute quantity to remove the micro-cracks after the grind processing or the surface layer portion is melted by glaze and the tissue of the surface is readjusted. Since the micro-cracks do not occur in the workpiece ground by the method of the present invention, the processes to solve the surface by hydrofluoric acid or readjustment of the tissue by flame after the grind processing are unnecessary.

According to the constitution of the present invention as explained above, a grinding method of a workpiece can be provided in which a processing surface of the workpiece is ground by using conventional abrasives or blast processing devices without use of, for example, extremely fine, special abrasives, grinding fluid or the like, to obtain a glossy surface such as a mirror surface.

Thereby occurrence of processing distortions on the processing surface of the workpiece is prevented and accordingly even in the case of grinding a workpiece such as silicon wafer to which the processing distortions are objectionable, a grinding method which can omit heat treatment to remove the processing distortions or removal of the surface layer by acid or alkali is provided.

And by use of a jet guide means and a jet regulation means of the present invention, abrasives are injected to a processing surface of a workpiece on the conditions required for easily carrying out the grinding method, for example, by use of a known blast processing device.

Thus the broadest claims that follow are not directed to a machine that is configure in a specific way. Instead, said broadest claims are intended to protect the heart or essence of this breakthrough invention. This invention is clearly new and useful. Moreover, it was not obvious to those of ordinary skill in the art at the time it was made, in view of the prior art when considered as a whole.

Moreover, in view of the revolutionary nature of this invention, it is clearly a pioneering invention. As such, the claims that follow are entitled to very broad interpretation so as to protect the heart of this invention, as a matter of law.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described;

What is claimed is:

1. A grinding method for a workpiece comprises the steps of:

injecting an abrasive together with compressed fluid to a processing surface of the workpiece with an incident angle to meet the condition shown in the following equation:

$$0<V\cdot\sin\theta\leqq\tfrac{1}{2}\cdot V \qquad \text{Equation 1;}$$

V=speed of the abrasive in an injection direction

θ=incident angle of the abrasive to the processing surface of the workpiece, and generating a jet of the abrasive along said processing surface of the workpiece.

2. A grinding method for a workpiece as set forth in claim 1, wherein said incident angle θ is 30° or less.

3. A grinding method for a workpiece as set forth in claim 1, wherein said incident angle θ is 20° or less.

4. A grinding method for a workpiece as set forth in claim 1, wherein said jet of the abrasive is introduced between the processing surface of the workpiece and a regulation plate arranged over the processing surface.

5. A grinding method for a workpiece as set forth in claim 2, wherein said jet of the abrasive is introduced between the processing surface of the workpiece and a regulation plate arranged over the processing surface.

6. A grinding method for a workpiece as set forth in claim 3, wherein said jet of the abrasive is introduced between the processing surface of the workpiece and a regulation plate arranged over the processing surface.

7. A grinding method for a workpiece as set forth in claim 1, wherein a protector covers said processing surface of the workpiece at an incident position of said abrasive.

8. A grinding method for a workpiece as set forth in claim 4, wherein a protector is disposed at one end of said regulation plate to cover said processing surface of the workpiece and said jet of the abrasive is introduced between the protector and the one end of said regulation plate.

9. A grinding method for a workpiece as set forth in claim 5, wherein a protector is disposed at one end of said regulation plate to cover said processing surface of the workpiece and said jet of the abrasive is introduced between the protector and the one end of said regulation plate.

10. A grinding method for a workpiece as set forth in claim 6, wherein a protector is disposed at one end of said regulation plate to cover said processing surface of the workpiece and said jet of the abrasive is introduced between the protector and the one end of said regulation plate.

11. A grinding method for a workpiece as set forth in claim 4, wherein a clearance between said regulation plate and said processing surface of the workpiece is arranged to be variable in response to speed and pressure of said jet of the abrasives to be introduced.

12. A grinding method for a workpiece as set forth in claim 5, wherein a clearance between said regulation plate and said processing surface of the workpiece is arranged to be variable in response to speed and pressure of said jet of the abrasives to be introduced.

13. A grinding method for a workpiece as set forth in claim 6, wherein a clearance between said regulation plate and said processing surface of the workpiece is arranged to be variable in response to speed and pressure of said jet of the abrasives to be introduced.

14. A jet guide means arranged between an injection gun of a blast processing device and a processing surface of a workpiece to be ground, comprising:

a guiding inlet positioned ahead of said injection gun in an injection direction thereof to introduce a jet of an abrasive injected from said injection gun;

a guide path formed in a predetermined curved shape to guide said jet introduced from said inlet opening; and a guiding outlet opening to guide said jet of the abrasives guided through said guide path, wherein a shape of said guide path, and a relative position between said guiding inlet and said guiding outlet are set so that said abrasives discharged from said outlet opening are injected to said processing surface of the workpiece with an incident angle shown in the following equation:

$$0<V\cdot\sin\theta\leqq\tfrac{1}{2}\cdot V \qquad \text{Equation 1;}$$

V=speed of the abrasive in an injection direction

θ=incident angle of the abrasive to the processing surface of the workpiece.

15. A jet regulation means located on a processing surface of a workpiece, comprising:

a regulation plate forming a clearance between the regulation plate and said processing surface, wherein the clearance can introduce a jet of abrasives injected together with compressed fluid to the processing surface at an incident angle θ to meet the condition shown in the following equation:

$$0<V\cdot\sin\theta\leqq\tfrac{1}{2}\cdot V \qquad \text{Equation 1;}$$

V=speed of the abrasive in an injection direction

θ=incident angle of the abrasive to the processing surface of the workpiece.

16. A jet regulation means as set forth in claim 15, wherein said regulation plate includes an oblique portion disposed at an end thereof where said jet of the abrasives is introduced, one end of the oblique portion being inclined in the direction of being away from said processing surface of the workpiece.

17. A jet regulation means as set forth in claim 15, further comprising:

a clearance retaining device which retains the clearance between said processing surface of the workpiece and said regulation plate at a predetermined clearance of 20 mm–2 mm, preferably 10 mm–2 mm or less.

18. A jet regulation means as set forth in claim 15, wherein said regulation plate is formed so as to vary the clearance with said processing surface of the workpiece.

19. A jet regulation means as set forth in claim 18, wherein said regulation plate is formed of flexible material.

20. A jet regulation means as set forth in claim 15, further comprising:

an urging means to urge said regulation plate toward said processing surface of the workpiece.

21. A jet regulation means as set forth in claim 15, further comprising:

a protector disposed at an end where said jet of the abrasives is introduced, to cover said processing surface of the workpiece wherein a clearance is formed between said protector and said regulation plate to introduce the jet of the abrasive therein.

* * * * *